US012577869B2

(12) United States Patent
Haugvaldstad et al.

(10) Patent No.: US 12,577,869 B2
(45) Date of Patent: Mar. 17, 2026

(54) SYSTEM, METHOD, AND APPARATUS FOR INSTRUMENTED ENGAGEMENT ELEMENTS

(71) Applicant: Schlumberger Technology Corporation, Sugar Land, TX (US)

(72) Inventors: Kjell Haugvaldstad, Vanvikan (NO); Harry Cook, Cambridge (GB); Edward Richards, Cheltenham (GB); Gokturk Tunc, Cambridge (GB); Jonathan Dunlop, Cambridge (GB); Jonathan Robert Hird, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 18/664,475

(22) Filed: May 15, 2024

(65) Prior Publication Data

US 2024/0384646 A1 Nov. 21, 2024

Related U.S. Application Data

(60) Provisional application No. 63/502,129, filed on May 15, 2023.

(51) Int. Cl.
*E21B 47/013* (2012.01)

(52) U.S. Cl.
CPC ..... *E21B 47/013* (2020.05)

(58) Field of Classification Search
CPC ..... E21B 47/017; E21B 47/01; E21B 47/013
See application file for complete search history.

(56) References Cited

U.S. PATENT DOCUMENTS

| | | | | |
|---|---|---|---|---|
| 4,181,360 | A | 1/1980 | Wilson | |
| 4,359,900 | A * | 11/1982 | Garney | E21B 47/017 73/152.52 |
| 5,720,355 | A * | 2/1998 | Lamine | E21B 17/003 175/45 |
| 6,230,822 | B1 | 5/2001 | Sullivan | |
| 6,419,032 | B1 | 7/2002 | Sullivan | |
| 6,540,033 | B1 | 4/2003 | Sullivan | |
| 6,543,312 | B2 | 4/2003 | Sullivan | |

(Continued)

FOREIGN PATENT DOCUMENTS

CN 101832130 A 9/2010

OTHER PUBLICATIONS

Dunlop, J. et al., "Increased Rate of Penetration Through Automation", SPE-139897, presented at the SPE-IADC Drilling Conference and Exhibition, Amsterdam, The Netherlands, 2011, 11 pages.

*Primary Examiner* — Shane Bomar
(74) *Attorney, Agent, or Firm* — Kyle R. Miiller

(57) ABSTRACT

An instrument assembly comprises an electronics housing disposed in a body of a downhole tool and an engagement element assembly connected to the electronics housing. The instrument assembly includes an engagement sensor positioned at a base of the engagement element assembly and configured to take measurements corresponding with an engagement of the engagement element assembly with a borehole. The instrument assembly includes an electronics housing seal configured to seal at least a portion of the electronics housing from a downhole pressure.

23 Claims, 18 Drawing Sheets

(56) References Cited

U.S. PATENT DOCUMENTS

| | | | | |
|---|---|---|---|---|
| 6,626,251 | B1 | 9/2003 | Sullivan | |
| 7,497,276 | B2 | 3/2009 | Pastusek | |
| 7,506,695 | B2 | 3/2009 | Pastusek | |
| 7,510,026 | B2 | 3/2009 | Pastusek | |
| 7,604,072 | B2 | 10/2009 | Pastusek | |
| 7,946,357 | B2 | 5/2011 | Trinh | |
| 8,162,077 | B2 | 4/2012 | Glasgow | |
| 8,695,729 | B2 | 4/2014 | Kumar | |
| 8,746,367 | B2 | 6/2014 | DiGiovanni | |
| 8,757,291 | B2 | 6/2014 | Kumar | |
| 8,807,242 | B2 | 8/2014 | Cheng | |
| 9,045,972 | B2 | 6/2015 | Cheng | |
| 9,145,741 | B2 | 9/2015 | Trinh | |
| 9,297,248 | B2 * | 3/2016 | Yao | E21B 47/013 |
| 9,500,070 | B2 | 11/2016 | DiGiovanni | |
| 9,695,683 | B2 | 7/2017 | Kumar | |
| 9,739,093 | B2 | 8/2017 | Trinh | |
| 10,072,492 | B2 | 9/2018 | DiGiovanni | |
| 10,662,769 | B2 | 5/2020 | Kumar | |
| 11,111,731 | B2 | 9/2021 | Cao | |
| 11,180,989 | B2 | 11/2021 | Cao | |
| 11,199,082 | B2 * | 12/2021 | DeVries | E21B 7/10 |
| 11,668,185 | B2 | 6/2023 | Zhan | |
| 11,828,165 | B2 | 11/2023 | Zhan | |
| 12,123,261 | B1 * | 10/2024 | Clark | E21B 10/567 |
| 12,305,506 | B1 * | 5/2025 | Cook | E21B 47/26 |
| 2004/0222018 | A1 | 11/2004 | Sullivan | |
| 2011/0024188 | A1 * | 2/2011 | Wassell | E21B 47/007 73/152.48 |
| 2011/0266054 | A1 * | 11/2011 | Kumar | E21B 10/08 175/428 |
| 2011/0266058 | A1 | 11/2011 | Kumar | |
| 2012/0272724 | A1 | 11/2012 | Hollmann | |
| 2012/0279783 | A1 | 11/2012 | Trinh | |
| 2013/0048381 | A1 * | 2/2013 | Habernal | E21B 47/013 175/50 |
| 2015/0114627 | A1 | 4/2015 | Tjhang | |
| 2015/0129230 | A1 | 5/2015 | Carlson | |
| 2016/0194951 | A1 | 7/2016 | Hay | |
| 2017/0103554 | A1 | 4/2017 | Elkington | |
| 2017/0275951 | A1 * | 9/2017 | Thomas | E21B 10/42 |
| 2019/0106979 | A1 | 4/2019 | Hadi | |
| 2020/0011171 | A1 * | 1/2020 | Cao | E21B 10/567 |
| 2020/0095831 | A1 | 3/2020 | Etebu | |
| 2021/0301641 | A1 | 9/2021 | Dunbar | |
| 2022/0381675 | A1 | 12/2022 | Haiz | |
| 2023/0015853 | A1 * | 1/2023 | Wort | E21B 10/56 |
| 2023/0124575 | A1 | 4/2023 | Moeny | |
| 2023/0296013 | A1 | 9/2023 | Lanning | |
| 2023/0333274 | A1 | 10/2023 | Tian | |
| 2024/0102378 | A1 * | 3/2024 | Nielsen | E21B 47/138 |
| 2024/0384652 | A1 | 11/2024 | Haugvaldstad | |
| 2024/0385346 | A1 | 11/2024 | Haugvaldstad | |

* cited by examiner

SYSTEM, METHOD, AND APPARATUS FOR INSTRUMENTED ENGAGEMENT ELEMENTS

CROSS-REFERENCE TO RELATED APPLICATION(S)

The present disclosure claims priority from U.S. Prov. Appl. No. 63/502,129, filed on 15 May 2023, herein incorporated by reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Wellbores can extend deep into the earth, often up to several kilometers. It is important and often difficult to accurately detect and map the geological formations to identify sources of oil, gas, heat or other valuable resources. For example, conventional techniques often implement imaging tools to measure various parameters of the surrounding rock, tools for collecting and removing samples of the earth formation for analyzing at the surface, and tools for detecting various downhole dynamics of the drilling system.

Some conventional tools can be expensive to operate, in part due to the fact that they can typically only be used when the well is not actively drilling. Some conventional tools may be implemented as part of a drilling tool assembly and/or while drilling. However, these tools are typically located a significant distance uphole of downhole tools that actively engage or cut the formation. Due to this, measurements from some conventional tools can have limited usefulness, for example, for determining or characterizing downhole dynamics as a downhole (engagement) tool interacts with the formation and/or taking measurements proximate a point of engagement of a downhole (engagement) tool. Additionally, the measurements (or images) from some conventional tools can have limited accuracy and/or resolution limiting their usefulness and/or the ability to detect and/or characterize geological features and/or downhole dynamics.

Thus, improved methods, systems, and devices for imaging the wellbore and/or mapping the earth formation while drilling, as well as for detecting downhole dynamics can have significant advantages over conventional techniques.

SUMMARY

In some embodiments, an instrument assembly comprises an electronics housing disposed in a body of a downhole tool and an engagement element assembly connected to the electronics housing. The instrument assembly includes an engagement sensor positioned at a base of the engagement element assembly and configured to take measurements corresponding with an engagement of the engagement element assembly with a borehole. The instrument assembly includes an electronics housing seal configured to seal at least a portion of the electronics housing from a downhole pressure.

In other embodiments, an engagement element assembly comprises an engagement element having a distal end and a base. An engagement sensor is positioned at the base of the engagement element. The engagement element assembly includes a connector configured to retain the engagement element in an engagement element pocket in a body of a downhole tool such that a force exerted on the distal end of the engagement element is transferred to the base of the engagement element. The engagement element assembly includes a seal configured to seal a pressure of the engagement element pocket.

In yet other embodiments, a method of using an engagement element assembly includes engaging a downhole earth formation with an engagement element of the engagement element assembly. The method includes transferring force from the engagement element to an engagement sensor. The force is associated with the engagement element engaging the downhole earth formation. The engagement sensor is positioned at a base of the engagement element and the engagement element is axially fixed. The method includes receiving engagement measurement from the engagement sensor with a processor located in an electronics housing.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 4-1 is a perspective cutaway view of a bit, according to at least one embodiment of the present disclosure;

FIG. 4-2 and FIG. 4-3 are a partial cutaway views of the bit of FIG. 4-1;

FIG. 17-1 is an exploded side cutaway view of an electronics housing system implemented in connection with a downhole tool, according to at least one embodiment of the present disclosure;

FIG. 17-2 is an assembled side cutaway view of the electronics housing system of FIG. 17-1;

DETAILED DESCRIPTION

Figure 1:
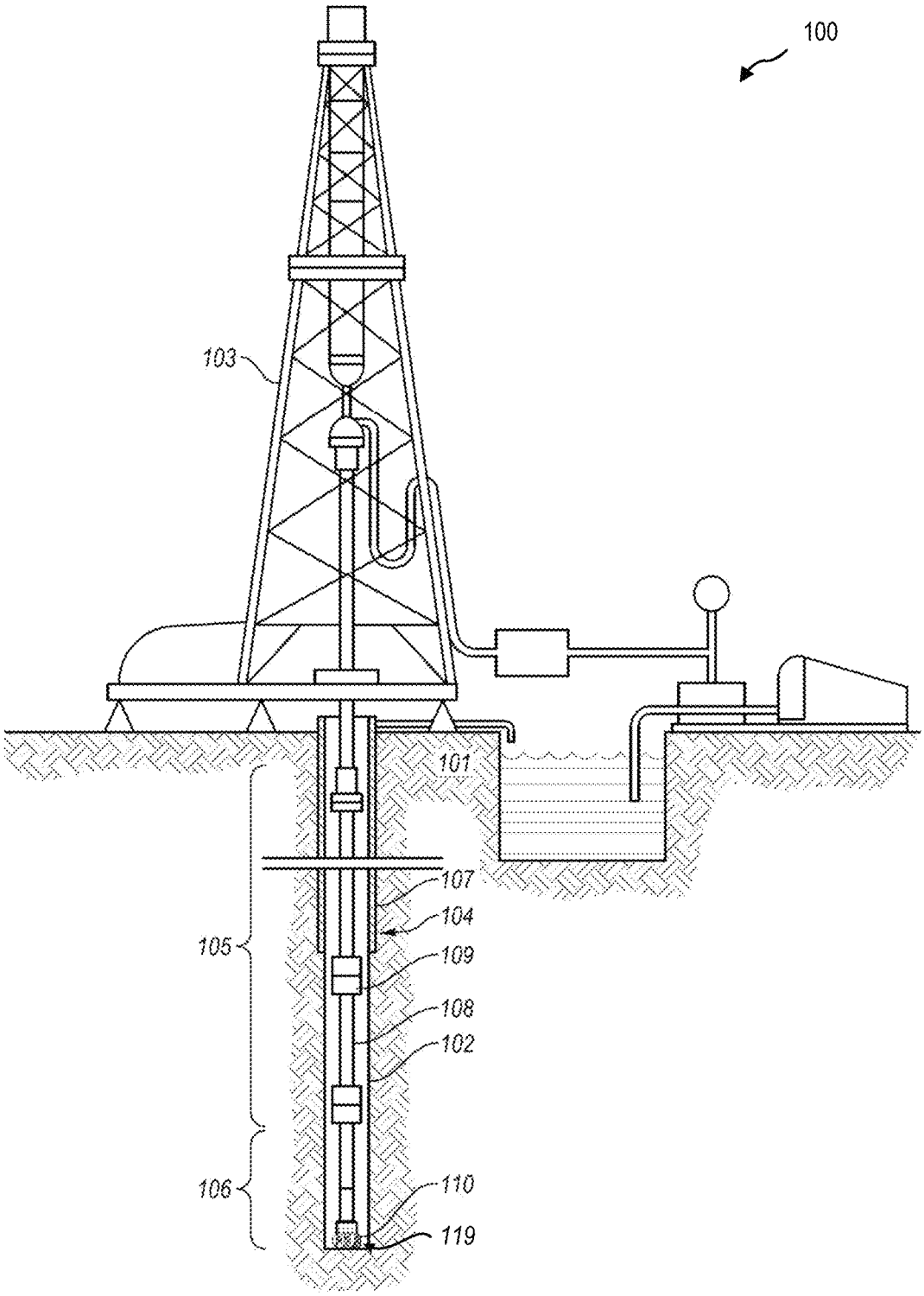
FIG. 1 shows one embodiment of a drilling system for drilling an earth formation, according to at least one embodiment of the present disclosure.

This disclosure generally relates to devices, systems, and methods for instrumented engagement elements. For example, a drilling system may implement one or more tools for engaging a borehole. An instrumented engagement element may be implemented in conjunction with one or more downhole tools and may engage the borehole. The instrumented engagement element may include one or more sensors for taking downhole measurements, such as engagement (e.g., force) measurements, associated with the engagement of the engagement element with the borehole. The observed downhole measurements (or more specifically changes in the observed downhole measurements) may be useful for determining and/or mapping one or more features of the borehole, in at least one embodiment described herein. Mapping the features of the borehole may facilitate, for example, identifying underground resources such as oil, gas, and heat, as well as making structural determinations about the earth formation.

Electronics such as a processor and/or a power supply may be associated with the sensor. These electronics may be located on or housed within the downhole tool. For example, the instrumented engagement element may be connected to the downhole tool at an engagement element pocket. An electronics housing may be connected to and/or may extend from the engagement element pocket and/or may house the electronics therein. In this way, the sensor of the instrumented engagement element may connect to the electronics. In another example, an electronics housing may be included at a distinct location from the engagement element pocket, such as in an inner bore of the downhole tool. An electronics housing system may include a wire conduit to direct wires from the sensor through the tool body to the inner bore. An adapter may connect the wire conduit to the electronics housing, and in this way, the sensor may connect to the electronics.

In at least one embodiment, the instrumented engagement element helps to protect the sensor and/or the electronics from damage. For example, the instrumented engagement element may seal an opening of the engagement element pocket and/or electronics housing such that downhole pressures and/or drilling fluid do not penetrate into the electronics housing. In another embodiment, the instrumented engagement element is disposed in an engagement element housing and the engagement element housing may seal the engagement element pocket and/or the electronics housing. In at least one embodiment, the instrumented engagement element forms a seal in this way to help protect the electronics from exposure to one or more aspects of the downhole drilling environment that may damage the electronics.

The engagement element housing may include one or more sensors in place of, or in addition to, an engagement sensor. For example, the engagement element housing may include a force sensor, a pressure sensor, a strain sensor, or a temperature sensor. In some embodiments, the engagement element assembly will not include the instrumented engagement element and/or the engagement sensor. In this way, at least one embodiment of the engagement element housing can be configured in any number of ways in order to take any number of relevant downhole measurements.

FIG. 1 shows one embodiment of a drilling system 100 for drilling an earth formation 101 (e.g., a downhole earth formation) to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 may transmit drilling fluid through a central bore and may transmit rotational power from the drill rig 103 to the BHA 106. Rotational power may also be transmitted through one or more mud motors located in the wellbore 102. In some embodiments, the drill string 105 further includes additional components such as subs, pup joints, etc.

The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore 102. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

The drilling system 100 may include one or more instrument assemblies 119. The instrument assembly 119 may be implemented in a downhole tool of the drilling system 100, such as the bit 110. The instrument assembly 119 may include one or more sensors, for example, for taking measurements (such as force) based on an engagement of one or more components of the instrument assembly with the borehole.

Figure 2:
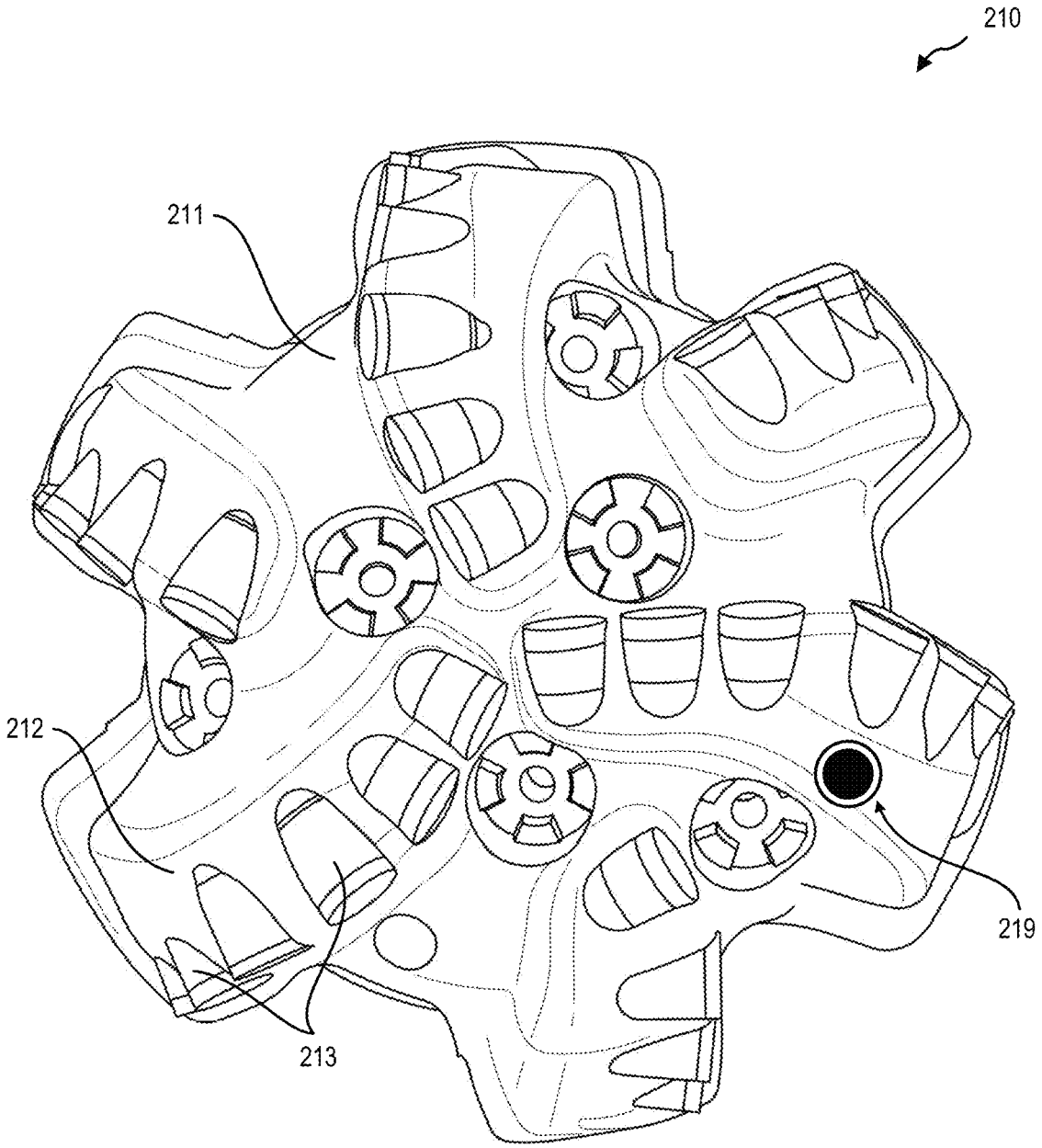
FIG. 2 is a bottom view of a downhole end of an embodiment of a bit, according to at least one embodiment of the present disclosure.

FIG. 2 is a bottom view of the downhole end of an embodiment of a bit 210, according to at least one embodiment of the present disclosure. The bit 210 may include a bit body 211 from which a plurality of blades 212 may protrude. At least one of the blades 212 may have a plurality of cutting elements 213 connected thereto. In some embodiments, at least one of the cutting elements is a planar cutting element, such as a shear cutting element. In other embodiments, at least one of the cutting elements is a non-planar cutting element, such as a conical cutting element (e.g., Stinger cutting elements) and/or a ridged cutting element.

In some embodiments, the bit 210 includes an instrument assembly 219. The instrument assembly 219 may include instrumentation for taking one or more downhole measurements with the bit 210. For example, the instrument assembly 219 may include one or more sensors for measuring force, strain, pressure, temperature, or combinations thereof.

In accordance with at least one embodiment of the present disclosure, the instrument assembly 219 includes an engagement element and an engagement sensor for measuring an engagement of the engagement element with a borehole. A power supply may provide power to the engagement sensor, and a processor and memory may receive and/or record engagement measurements from the engagement sensor. In this way, the engagement element may engage the borehole, and the instrument assembly may take corresponding measurements (e.g., axial forces and/or other measurements) on the engagement element. The engagement measurements may facilitate creating or generating one or more of a graph, plot, image, or map of the parameters experienced by the bit 210 in order to illustrate one or more properties and/or features associated with the materials encountered by the bit 210 while drilling the borehole.

Figure 3:
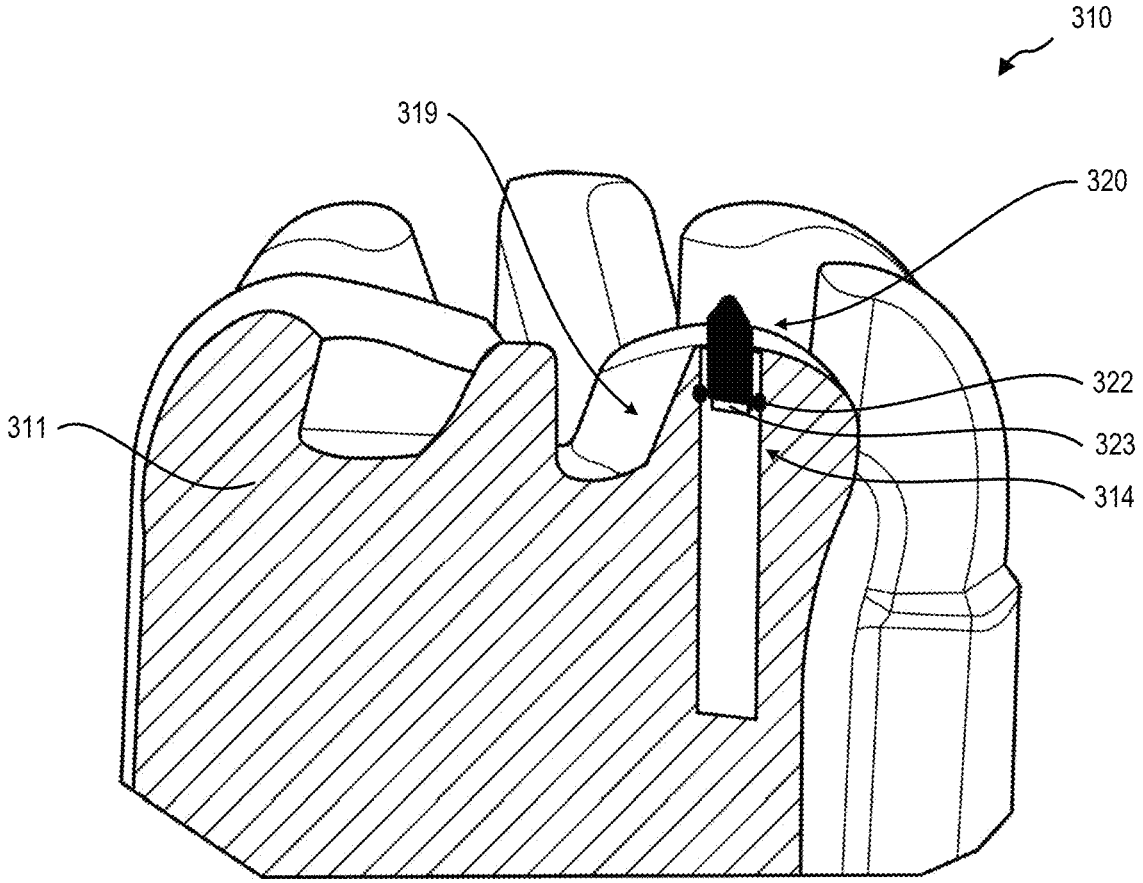
FIG. 3 is a perspective cutaway view of a bit, according to at least one embodiment of the present disclosure.

FIG. 3 is a perspective cutaway view of a bit 310, according to at least one embodiment of the present disclosure. As just mentioned, in some embodiments, the bit 310 includes an instrument assembly 319. The instrument assembly 319 may include an electronics housing 314. The electronics housing 314 may be disposed in a bit body 311 of the bit 310. The electronics housing 314 may define a volume within the bit 310 to, for example, house electronics of the instrument assembly 319, as will be discussed herein.

In some embodiments, the instrument assembly 319 includes an engagement element assembly 320. The engagement element assembly 320 may connect to the bit 310 by connecting to the electronics housing 314. For example, the electronics housing 314 may include or define (e.g., may form) an engagement element pocket, and the engagement element assembly 320 may connect to the engagement element pocket. The engagement element assembly 320 may connect to the electronics housing 314 with a sealed connection. For example, the instrument assembly 319 may include a seal 322. The seal 322 may be positioned between the electronics housing 314 and the engagement element assembly 320 to seal the electronics housing 314. For example, the electronics housing 314 may be sealed with a pressure (e.g., atmospheric pressure) and the seal 322 may maintain the pressure within the electronics housing 314. In some embodiments, fluid (e.g., drilling fluid) is present in the borehole, and the seal 322 prevents the fluid from penetrating into the electronics housing 314. In this way, the engagement element assembly 320 may connect to the electronics housing 314 to create a sealed volume to, for example, protect electronics housed in the electronics housing 314.

In some embodiments, the instrument assembly 319 includes a sensor 323. The sensor 323 may be an engagement sensor for taking one or more measurements associated with an engagement of the engagement element assembly 320 with a borehole. For example, the engagement sensor may be a force sensor. In some embodiments, the sensor 323 is positioned at a base of the engagement element assembly 320, and may, for example, take measurements based on a force exerted on the engagement element assembly 320. For example, the electronics housing 314 may have one or more inner structural features for holding and/or supporting the sensor 323 and/or the engagement element assembly 320. In this way, a force exerted on the engagement element assembly 320 may correspond with measurements taken by the sensor 323.

Figures 1, 4:
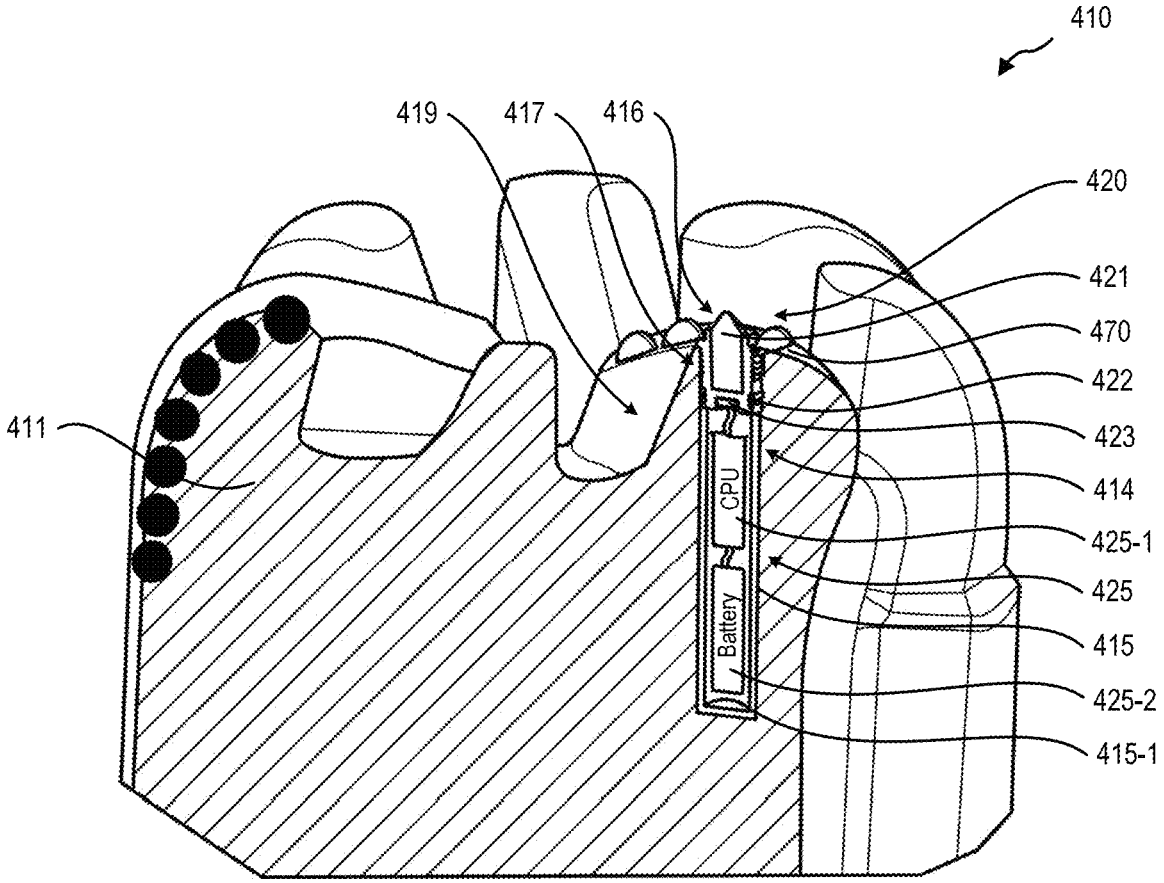
Figures 2, 4:
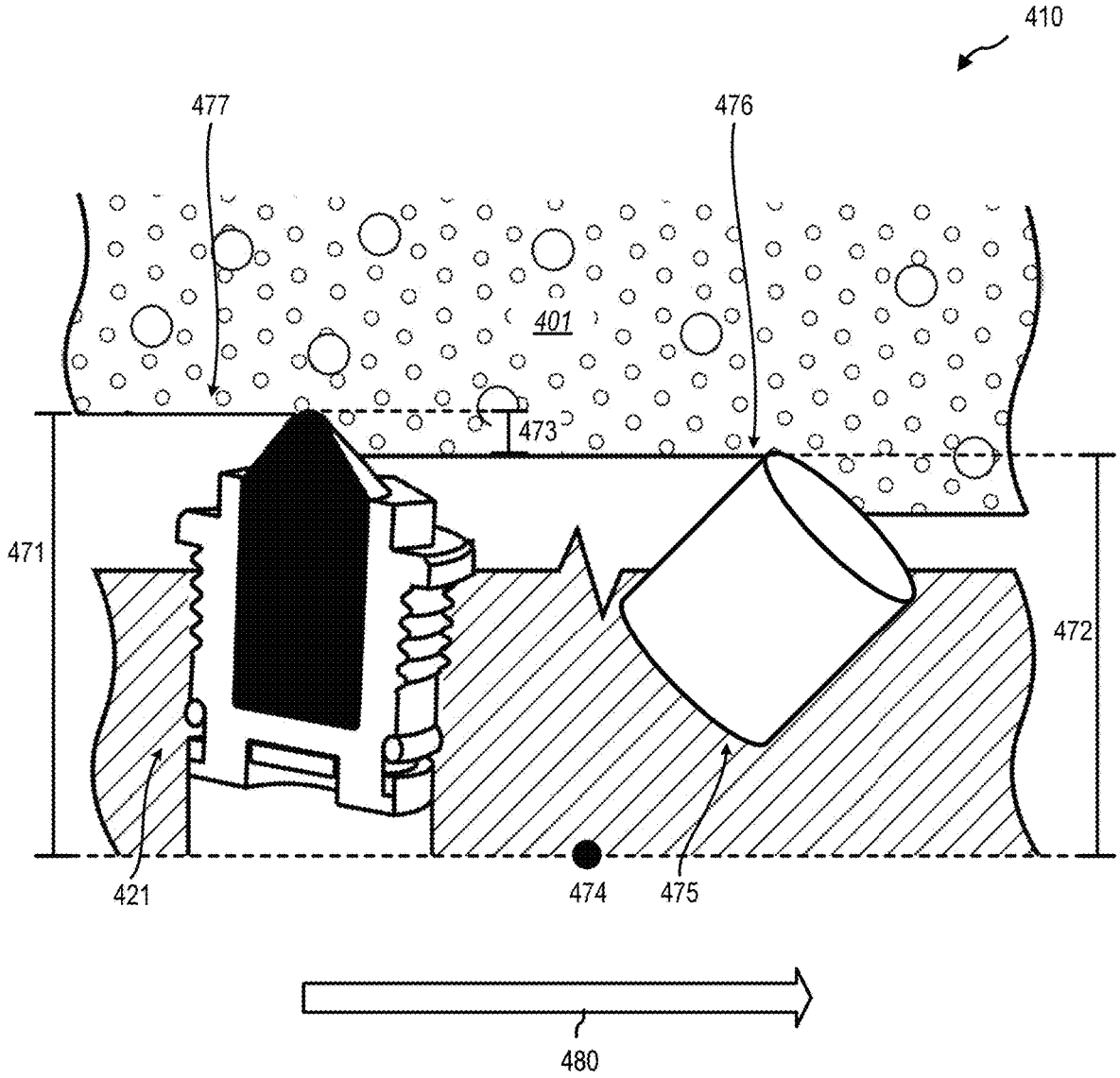
Figures 3, 4:
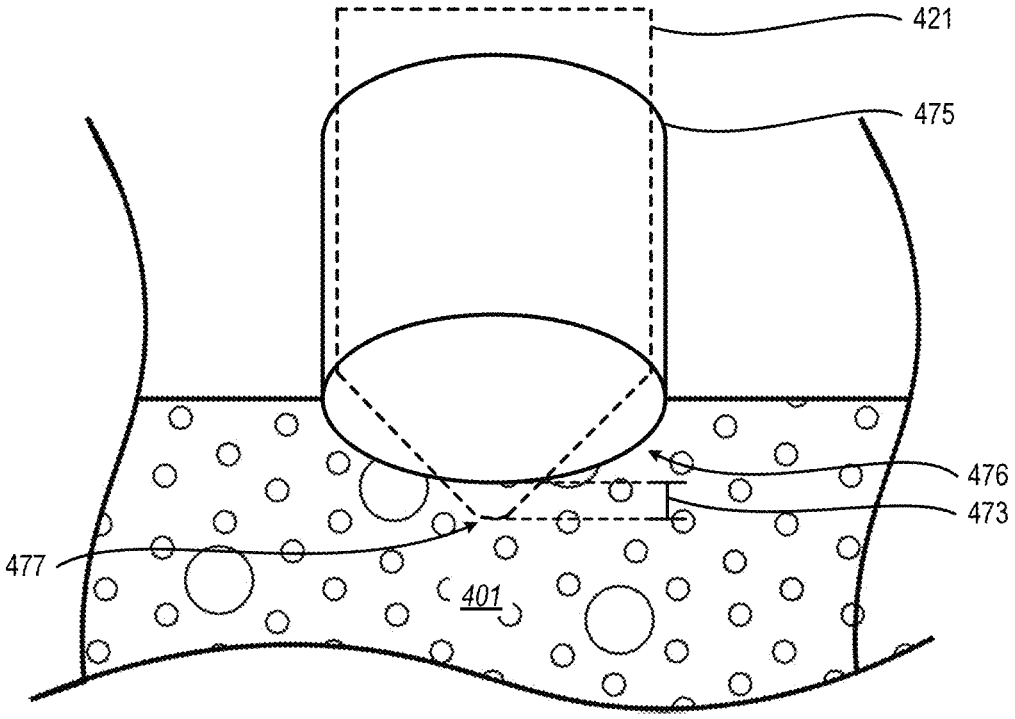

FIG. 4-1 is a perspective cutaway view of a bit 410 according to at least one embodiment of the present disclosure. In some embodiments, the bit 410 includes an instrument assembly 419. The instrument assembly may include an engagement element assembly 420 that connects to an electronics housing 414. In some embodiments, the engagement element assembly 420 removably connects to the electronics housing 414. In other words, the engagement element assembly 420 may not be permanently attached to the bit 410, for example, by brazing the engagement element assembly 420 to the bit 410 as is conventionally done. In this way, the engagement element assembly 420 may be selectively connected to and/or removed from the bit 410. In at least one embodiment, this may facilitate incorporating electronics 425 and/or a sensor 423 into the bit 410. For example, the electronics 425 may be installed into the electronics housing 414 and connected to the sensor 423, after which the engagement element assembly 420 may be connected to the electronics housing 414 to complete the installation of the instrument assembly 419. This may facilitate implementing and/or replacing sensing and/or measurement devices such as those included in the instrument assembly 419 by significantly simplifying the implementation of such devices in a downhole tool such as the bit 410, in at least one embodiment.

In some embodiments, the engagement element assembly 420 includes a sensor engagement element 421. The sensor engagement element 421 may be a planar engagement element, a non-planar (e.g., conical, hemispherical, bullet, etc.) engagement element such as a Stinger engagement element, or any other engagement element. The sensor engagement element 421 may be an engagement element or may be configured to engage the borehole. For example, the sensor engagement element 421 may be at least partially composed of an ultrahard material, such as a polycrystalline diamond compact (PCD). As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissanite, hexagonal diamond (Lonsdaleite), cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)) and other materials in the boron-nitrogen-carbon-oxygen system which have shown hardness values above 1,500 HV, as well as combinations of the above materials. In some embodiments, the ultrahard material has a hardness value above 3,000 HV. In other embodiments, the ultrahard material has a hardness value above 4,000 HV. In yet other embodiments, the ultrahard material has a hardness value greater than 80 HRa (Rockwell hardness A). In some examples, the sensor engagement element 421 is formed from any other material including metals, metallic alloys, ceramic materials, any other material, and combinations thereof.

The engagement element assembly 420 may be connected to the electronics housing 414 such that the sensor engagement element 421 extends at least partially past an outer surface 470 of the bit 410. For example, the sensor engagement element 421 may extend from the bit 410 such that the sensor engagement element 421 may engage the borehole during drilling with the bit 410. The sensor engagement element 421 may extend in a substantially vertical direction (e.g., substantially downhole). This may facilitate an engagement of the sensor engagement element 421 with the borehole.

In some embodiments, the instrument assembly includes a sensor 423. The sensor 423 may be an engagement sensor and may take measurements associated with an engagement of the sensor engagement element 421 with the borehole. The sensor 423 may be positioned at a base of the engagement element assembly 420. The sensor 423 may be positioned at a base of the sensor engagement element 421. For example, a conduit 415 and/or the engagement element assembly 420 may have one or more structural features for holding and/or supporting the sensor 423 with respect to the sensor engagement element 421. When the sensor engagement element 421 engages the borehole, a force exerted on the engagement element 421 may be transferred through the base of the sensor engagement element 421 to the sensor 423. In some embodiments, the force is an axial force. In this way, the sensor 423 may take measurements based on a force of the sensor engagement element 421. This may facilitate taking measurements associated with the formation encountered by the sensor engagement element 421. For example, materials (e.g., geological materials) in the formation may exhibit varying material properties such as hardness, which may correspond to varying measurements (e.g., forces) sensed by the sensor engagement element 421. In another example, features in the formation such as cracks or veins may correspond to varying measurements (e.g., forces) sensed by the sensor engagement element 421. The sensor 423 may measure these changes, and in this way, detect the features and/or properties of the formation.

In this way, the sensor 423 takes measurements associated with the sensor engagement element 421 engaging the borehole. For example, the sensor 423 may measure strain, stress, displacement, pressure, deformation, deflection or any other parameter associated with an engagement of the sensor engagement element 421 with the borehole. These measurements may facilitate calculating or determining a force on the sensor engagement element 421 or determining any other dynamic related to an engagement of the sensor engagement element 421 with the borehole. The sensor 423 may include a strain gauge, a hall effect sensor, a magnet, a capacitive sensor, a spring sensor, any other sensor, or combinations thereof.

As mentioned above, the instrument assembly 419 includes an electronics housing 414 disposed in the bit body 411. In some embodiments, the electronics housing includes, or defines a conduit 415 extending into the bit body 411. The conduit 415 may have an elongate shape. For example, the conduit 415 may be substantially cylindrical. The conduit 415 may be any other shape in accordance with that disclosed herein. The conduit 415 may extend into the bit 410 such that a volume is defined within the bit body 411.

In some embodiments, the instrument assembly 419 includes a seal 422. The seal 422 may be positioned between the engagement element assembly 420 and the electronics housing 414. For example, the seal 422 may be an O-ring seal such as a metal, rubber or plastic O-ring seal. The seal 422 may be a gasket seal. The seal 422 may be a surface seal. For example, the electronics housing 414 and the engagement element assembly 420 may each have a sealing surface, and these sealing surfaces may interface in order to form the seal 422. The seal 422 may function to seal the inner volume of the electronics housing 414. For example, the electronics housing 414 may be sealed to maintain an inner pressure of the electronics housing 414. The electronics housing 414 may be sealed to prevent fluid from penetrating into the electronics housing 414. This may facilitate using and/or protecting electronics within the sealed portion of the electronics housing 414.

The volume of the electronics housing 414 may be of such a size and/or shape so as to house the electronics 425. For example, the electronics 425 may include a processor 425-1 and/or a battery 425-2. The electronics 425 may include one or more additional components such as memory, communication devices, etc. The electronics 425 may be coupled to and/or associated with the sensor 423. For example, the battery 425-2 may power a function of the sensor 423. The processor 425-1 may receive and/or record one or more measurements of the sensor 423 (e.g., process and/or save to memory). The electronics 425 may be positioned within the sealed portion of the electronics housing 414. In some embodiments, the sensor 423 is positioned in the sealed portion of the electronics housing 414 which may facilitate the sensor 423 connecting with the electronics 425 (e.g., through a wired connection). In this way, the electronics housing 414 may facilitate implementing one or more electronic components into the bit 410, such as a processor for receiving downhole measurements from the sensor 423.

The electronics housing 414 may have an opening 416. The opening 416 may be positioned at an outer surface of the bit body 411. In some embodiments, the engagement element assembly 420 connects to the electronics housing 414 at the opening 416. For example, a portion of the electronics housing 414 proximate or adjacent to the opening 416 may be an engagement element pocket 417. The engagement element pocket 417 may be a portion of the electronics housing 414 that is configured to connect to and/or retain the engagement element assembly 420. In some embodiments, the engagement element pocket 417 is separate from the conduit 415. For example, the engagement element pocket 417 may be at a distinct location on the bit 410 from the conduit. The engagement element pocket 417 may form or define a separate cavity from that of the conduit 415. In this way, the electronics 425 may be housed at a separate location from the engagement element assembly 420 and/or the sensor 423.

In accordance with at least one embodiment of the present disclosure, the opening 416 may be at a distal (e.g., downhole) end of the conduit 415. The opening may be at the outer surface 470 of the bit body 411 and may provide access to the electronics housing 414, for example, for inserting and/or connecting the electronics 425. The engagement element pocket 417 may be a portion of the conduit 415 that is adjacent or proximate the opening 416. In this way, the engagement element pocket 417 and the conduit 415 may be located or formed in the same cavity in the bit body 411. This may facilitate and/or simplify installing and/or connecting one or more of the electronics 425, the engagement element assembly 420, and the sensor 423. The opening 416 (and in this example the engagement element pocket 417) may be at an outer surface of the bit body 411 that is a downhole end of the bit 410. This positioning may facilitate the engagement element assembly 420 and/or the sensor engagement element 421 extending from the outer surface of the bit body 411.

In some embodiments, the conduit 415 includes a sleeve 415-1. For example, the sleeve 415-1 may have substantially the same shape as the conduit 415, and may be hollow, or may have an inner bore. In some embodiments, the sleeve 415-1 is substantially the shape of a hollow cylinder. The sleeve 415-1 and/or conduit 415 may be any other shape suitable for housing the electronics 425 as described herein. In some embodiments, the sleeve 415-1 is disposed within and/or connected to the conduit 415. For example, the sleeve 415-1 may be brazed into the conduit 415. The sleeve 415-1 may be glued, pressed, or threaded into the conduit, or any other form of connection suitable for connecting the sleeve 415-1 to the conduit 415. The sleeve 415-1 may span an entire length of the conduit 415 such that the sleeve 415-1 substantially makes up an entirety of the conduit 415. For example, one or more of the features of the conduit 415 described herein (e.g., sealing feature, connection with the engagement element assembly, etc.) may be included as part of the sleeve 415-1. In some embodiments, the sleeve 415-1 spans or encompasses only a portion of the conduit 415. For example, the sleeve 415-1 may define or be associated with the sealed portion of the electronics housing 414. As another example, the sleeve 415-1 may not include or be associated with the connection of the engagement element assembly 420 with the electronics housing 414.

The sleeve 415-1 may at least partially define or create the sealed volume of the electronics housing 414. The sleeve 415-1 may be configured to withstand the pressure differential between the sealed volume and an exterior of the bit 410. For example, the sleeve 415-1 may have a wall thickness that is selected to prevent collapse under the pressure differential.

In some situations, the material properties of the metal matrix of the bit body 411 make it difficult to include one or more features of the conduit 415 discussed herein. The sleeve 415-1 may be more easily machined or manufactured to facilitate including one or more of these features. In some embodiments, the sleeve 415-1 is manufactured before it is installed into the bit 410. In some embodiments, the sleeve 415-1 is installed into the bit 410 and after one or more features of the electronics housing 414 have been machined or manufactured into the sleeve 415-1. In this way, the electronics housing 414 may include the sleeve 415-1 to facilitate including one or more features of the instrument assembly 419.

In some embodiments, the conduit 415 is oriented in a longitudinal direction relative to the bit 410. For example, a longitudinal axis of the conduit 415 may be oriented such that it is parallel to a longitudinal axis of the bit 410. The longitudinal axis of the bit 410 may be an axis of rotation of the bit 410. In this way, the conduit 415 may be oriented substantially vertically, for example, during downhole drilling activities of the bit 410. This may facilitate the engagement element assembly 420 and/or the engagement element 421 extending substantially vertically (e.g., downhole) from the bit 410.

While one or more components of the instrument assembly 419 are shown in FIG. 4-1 as being substantially vertical or located substantially in a longitudinal plane of the bit 410, it should be understood that one or more of the components of the instrument assembly 419 may be oriented, for example, at an angle relative to the longitudinal plane of the bit 410. Indeed, one or more of the components of the instrument assembly 419 may be included in the bit 410 at any orientation consistent with drilling the borehole and/or taking measurements as described herein. For example, one or more of the conduit 415, the engagement element assembly 420 and the engagement element pocket 417 may be oriented horizontally, as will be discussed in connection with FIG. 6. In another example, one or more of the conduit 415, the engagement element assembly 420, and the engagement element pocket 417 may be oriented diagonally or at any other angle relative to the longitudinal plane. This may facilitate implementing the instrument assembly 419 in a variety of drilling tools.

In some embodiments, the electronics housing 414 (more specifically, the engagement element pocket 417) is positioned in the bit body 411 such that the engagement element assembly 420 and/or the sensor engagement element 421 extends from the bit 410 adjacent to and/or behind an engagement element (such as engagement element 213 of FIG. 2) of the bit 410. For example, during drilling activities, the bit 410 may rotate such that the engagement elements follow a rotational path. The sensor engagement element 421 may be positioned such that it follows a rotational path that is the same as one of the engagement elements of the bit 410. In other words, the rotational path of the sensor engagement element 421 may be a rotational path that has a radius that is substantially the same as a rotational path of a cutting element of the bit 410. In this way the sensor engagement element 421 may follow the rotational path of a lead cutting element 475. While FIG. 4-2 illustrates the lead cutting element 475 as an engagement element of the bit 410 that is adjacent to the sensor engagement element 421 as well as immediately and/or rotationally ahead of the sensor engagement element 421, it should be understood that the lead cutting element 475 may be positioned at any location of the bit 410 (as discussed below) and/or may be any of the engagement elements of the bit 410.

The sensor engagement element 421 may follow the rotational path of the lead cutting element 475 by being positioned an offset angle from the lead cutting element 475. For example, the offset angle may be an angle measured about the axis of rotation of the bit 410 (e.g., measured in the direction and plane of the rotation of the bit 410) between the lead cutting element 475 and the sensor engagement element 421. In this way the offset angle may correspond to an angle between a point of engagement of the lead cutting element 475 with the earth formation and a point of engagement of the sensor engagement element 421 with the earth formation.

In some embodiments, the sensor engagement element 421 is positioned substantially adjacent or proximate the lead cutting element 475. For example, the offset angle may be small, such as 1°, and the sensor engagement element 421 may be positioned immediately (rotationally) behind the lead cutting element 475. In another example, the offset angle may be large, and the sensor engagement element 421 may be positioned immediately (rotationally) ahead of the lead cutting element 475. In some embodiments, the adjacent or proximate positioning of the sensor engagement element 421 with the lead cutting element 475 may correspond with the sensor engagement element 421 and the lead cutting element 475 being positioned in the same blade of the bit 410.

In some embodiments, the sensor engagement element 421 is not positioned adjacent or proximate the lead cutting element 475. For example, the offset angle may be any angle between 1° and 359°, such as 45°, 90°, 180°, 270°, or any other angle. In some embodiments, this corresponds with the sensor engagement element 421 being positioned in the same blade of the bit 410 as the lead cutting element 475. In some embodiments, this corresponds with the sensor engagement element 421 being positioned in a different blade (or not in a blade) of the lead cutting element 475. In this way, the sensor engagement element 421 may be positioned at any offset angle from the lead cutting element 475 such that the sensor engagement element 421 follows along substantially the same rotational path as the lead sensor cutting element 475. In some embodiments, the sensor engagement element 421 and/or the lead cutting element 475 are each positioned in a blade of the bit 410. In some embodiments, the sensor engagement element 421 and/or the lead cutting element 475 are each not positioned in a blade of the bit 210.

FIGS. 4-2 and 4-3 are schematic views illustrating an engagement of the sensor engagement element 421 and the lead cutting element 475. It should be understood that the positioning of the sensor engagement element 421 and the lead cutting element 475 in FIG. 4-2 as being adjacent, proximate, or substantially side-by-side is for illustrative purposes only. The positioning and/or spacing of the sensor engagement element 421 and the lead cutting element 475 may correspond with any offset angle as described above. In this way, FIG. 4-2 illustrates the sensor engagement element 421 and the lead cutting element 475 with respect to a rotation 480 of the bit 410, and not necessarily with respect to an actual or physical position on the bit 410. Similarly, it should be understood that FIG. 4-3 is not necessarily illustrating the sensor engagement element 421 and the lead cutting element 475 with respect to, for example, a positioning of each in the bit 410. Rather, FIG. 4-3 is illustrative of the engagement of the sensor engagement element 421 and the lead cutting element 475 with the earth formation 401.

As discussed herein, the sensor engagement element 421 engages an earth formation 401 in order to take one or more corresponding measurements. In some embodiments, the sensor engagement element 421 engages the earth formation 401 by contacting and/or extending into the earth formation 401. This may be characterized by an engagement distance 473. For example, the lead cutting element 475 may engage the earth formation and may cut and/or remove a lead groove 476. The sensor engagement element 421 may extend into the formation 401 at or in the lead groove 476 (e.g., as shown in FIG. 4-3) and may produce a trailing groove 477. The engagement distance 473 may be the difference between the furthest extent (e.g., downhole) of the lead groove 476 and the trailing groove 477. In this way, the engagement distance 473 may correspond to a distance or the furthest extent that the sensor engagement element 421 extends into the formation 401 upon engagement.

In some embodiments, the engagement distance 473 may be 1 mm. The engagement distance 473 may be in a range having an upper value, a lower value, or upper and lower values including any of 0.1 mm, 0.2 mm, 0.3 mm, 0.4 mm, 0.5 mm, 0.6 mm, 0.7 mm, 0.8 mm, 0.9 mm, 1 mm, 2 mm, 3 mm, 4 mm, 5 mm, 10 mm, or any value therebetween. For example, the engagement distance 473 may be less than 10 mm. In another example, the engagement distance may be greater than 0.1 mm. In yet another example, the engagement distance 473 may be between 0.1 mm and 10 mm. In some embodiments the engagement distance 473 is less than 1 mm to ensure that the sensor engagement element 421 experiences a significant enough engagement with the formation 401 to accurately take one or more measurements while minimizing noise in the measurements.

The sensor engagement element 421 may extend axially (e.g., downhole) a sensor axial distance 471. The lead cutting element 475 may extend axially (e.g., downhole) a cutting axial distance 472. The sensor axial distance 471 and the cutting axial distance 472 may each be a distance measured between a point of engagement of the sensor engagement element 421 and the lead cutting element 475 (respectively) with the formation 401, and a reference point 474, such as at a base of a blade of the bit 410. The reference point 474 may be any reference point for measuring the sensor axial distance 471 and the cutting axial distance 472 relative to the engagement of the sensor engagement element 421 and the lead cutting element 475 with the formation 401. For example, the sensor engagement element 421 may be implemented in a downhole tool that engages the wall of a borehole (e.g., rather than the bottom of the borehole), and the sensor axial distance 471 and the cutting axial distance 472 may be measured from the reference point 474 radially outward to an engagement of the sensor engagement element 421 and the lead cutting element 475 with the borehole wall, respectively. In this way, the sensor engagement element 421 may follow the same rotational path as the lead cutting element 475 (e.g., rotationally behind), while still engaging the borehole within a groove or channel cut by the lead cutting element 475, as described in connection with FIG. 5. The sensor axial distance and/or the cutting axial distance 472 may be determined or configured such that the sensor engagement element 421 engages the formation 401 with the engagement distance 473, in accordance with that discussed above.

In some embodiments, the sensor axial distance 471 may be greater than the cutting axial distance 472. In other words, the sensor engagement element 421 may axially extend (e.g., downhole) further than the lead cutting element 475. This may correspond with the sensor engagement element 421 being positioned with a smaller offset angle, such as less than 180°. In this way, the sensor engagement element 421 may extend axially and engage the earth formation after the lead cutting element 475 has cut the lead groove 476.

In some embodiments, the sensor axial distance 471 may be substantially the same, or even less than the cutting axial distance 472. This may correspond with the sensor engagement element 421 being positioned with a larger offset angle, such as greater than 180°. For example, while the earth formation has been illustrated in some of the figures herein as having a face that is substantially horizontal or substantially parallel with respect to the bit 410 and/or the various engaging elements of the bit 410, due to the rotation of the bit 410, as well as the bit advancing downhole through the formation 401 as it rotates, in some situations, the face of the formation 401 may have a helical or spiral nature such that the face of the formation may be represented as slanted or not parallel with respect to bit 410. In this way, the sensor engagement element 421 may extend axially and engage the earth formation after the lead cutting element 475 has cut the lead groove 476, even though the sensor engagement element 421 may not extend axially further than the lead cutting element 475. In this way, the configuration of the sensor axial distance 471 and/or the cutting axial distance 472 may be based on or dependent on the offset angle as discussed above.

In some embodiments, the one or more sensors are connected to one or more other components of the BHA. In some embodiments, the one or more sensors include a transmitter to transmit sensor data. For example, the transmitter may transmit sensor data to other components of the BHA. In another example, the transmitter may transmit sensor data to the surface.

As discussed herein, the sensor engagement element 421 may follow the same (or similar) rotational path as the lead cutting element 475. This may correspond with the sensor engagement element 421 engaging the formation 401 within the lead groove 476 cut or removed by the lead cutting element 475. The sensor engagement element 421 may be positioned and/or oriented such that the width of the trailing groove 477 never breaches the width of the lead groove 476 as the sensor engagement element 421 follows rotationally behind the lead cutting element 475. For example, the sensor engagement element 421 may engage the formation 401 at a center of the lead groove 476. In another example, the sensor engagement element 421 may engage the borehole at another location of the lead groove 476 that is not centered. The sensor engagement element 421 may engage the formation 401 within the lead groove 476 at an angle (e.g., relative to a longitudinal axis of the sensor engagement element 421), such as a normal or perpendicular angle, or any other angle.

The sensor engagement element 421 may follow behind the lead cutting element 475 in this way to facilitate a measurement and/or calculation of the force on the sensor engagement element 421, or any other parameters associated with an engagement of the sensor engagement element 421 with the borehole. For example, the sensor engagement element 421 may engage the formation 401 in substantially the same way regardless of a depth of cut and/or a rate of penetration of the bit. For a given geometry of rock or material being removed, the force acting on an engagement element (e.g., a cutter) may be proportional to the area of rock being cut or removed. The sensor engagement element 421 may engage the formation 401 within the lead groove 476 in order to maintain the geometry (more specifically, the area) of rock being removed by the sensor engagement element 421 substantially uniform. This may result in a substantially uniform engagement of the sensor engagement element 421 with the formation 401 at all depths of cut and/or rates of penetration of the lead cutting element 475 and/or a downhole tool implementing the lead cutting element 475 and the sensor engagement element 421. In contrast, if the sensor engagement element 421 were to not follow directly behind the lead cutting element 475 and/or engage the formation 401 within the lead groove 476, the area of rock with which the sensor engagement element 421 engages (e.g., removes) may vary based on the depth of cut of the lead cutting element 475, significantly complicating the calculation of the force (or other parameter) on the sensor engagement element 421. In this manner, changes in the measured force (or other parameter) on the sensor engagement element 421 may be attributable to changes or features in the formation 401 (e.g., changes in material, changes in hardness, veins or cracks in the formation, etc.), rather than changes in the geometry of the cut of the sensor engagement element 421 (e.g., due to different depth of cut of the lead cutting element).

Figure 5:
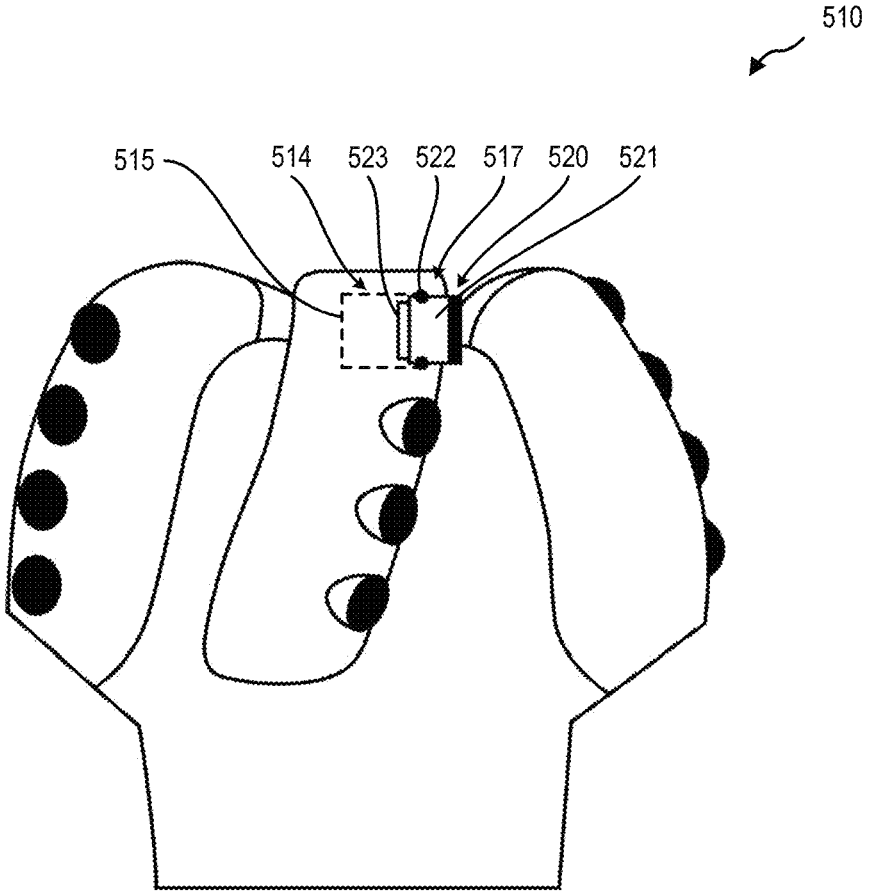
FIG. 5 is a schematic illustration of a sensor engagement element and a lead cutting element engaging a borehole, according to at least one embodiment of the present disclosure.

FIG. 5 is a side view of a bit 510, according to at least one embodiment of the present disclosure. In some embodiments, the bit 510 includes an electronics housing 514 defined at least partially by a conduit 515. An engagement element pocket 517 may be connected to and/or associated with the conduit 515 for retaining an engagement element assembly 520. A seal 522 may be positioned between the engagement element assembly 520 and the engagement element pocket 517 in order to seal the engagement element pocket 517 and/or the conduit 515. In some embodiments, the conduit 515 and/or the engagement element pocket 517 are not oriented in a longitudinal direction and/or are not oriented parallel to an axis of rotation of the bit 510. In some embodiments, the conduit 515 and/or the engagement element pocket 517 are oriented substantially horizontally, and/or substantially tangent to a rotation of the bit 510. In this way, the engagement element assembly 520 and/or a sensor engagement element 521 do not extend vertically or axially from the bit 510 but may extend in a rotational or radial direction of the bit 510. In some embodiments, the conduit 515 and the engagement element pocket 517 are connected as part of the same cavity in the bit 510. In this way, the sensor 523 and/or electronics associated with the sensor 523 may be located adjacent and/or behind the engagement element assembly 520. The sensor 523 and/or electronics associated with the sensor 523 may be in a sealed portion of the electronics housing 514. In some embodiments, the engagement element pocket 517 is positioned in the bit 510 as shown, and the conduit 515 is positioned at a separate location in the bit 510. In this way, the sensor 523 and/or electronics associated with the sensor 523 may be located at a distinct location from the engagement element assembly 520 (e.g., the sensor 523 may be connected to the engagement element assembly 520 via a linkage).

The sensor engagement element 521 may be included in the bit 510 as one of the engagement elements for cutting (e.g., actively cutting) the borehole (such as engagement element 213 of FIG. 2). The sensor engagement element 521 may experience a force in a horizontal or rotational direction, and the sensor 523 may measure the force. The measured force in this manner may facilitate determining the rotational forces exerted on the engagement elements and/or torques exerted on the bit 510. Changes in the measured force may also facilitate identifying features in the formation, as discussed herein. The horizontal or rotational forces experienced by the sensor engagement element 521 may facilitate taking and/or measuring one or more parameters other than force, such as strain, stress, pressure, deformation, deflection, etc.

While the engagement element assembly 520, the conduit 515, and the engagement element pocket 517 are shown in FIG. 5 as being substantially horizontal or located substantially in a radial plane of the bit 510, it should be understood that one or more of the engagement element assembly 520, the conduit 515, and the engagement element pocket 517 may be oriented, for example, at an angle relative to the radial plane of the bit 510. Indeed, one or more of the engagement element assembly 520, the conduit 515, and the engagement element pocket 517 may be included in the bit 510 at any orientation consistent with drilling the borehole and/or taking measurements as described herein.

Figure 6:
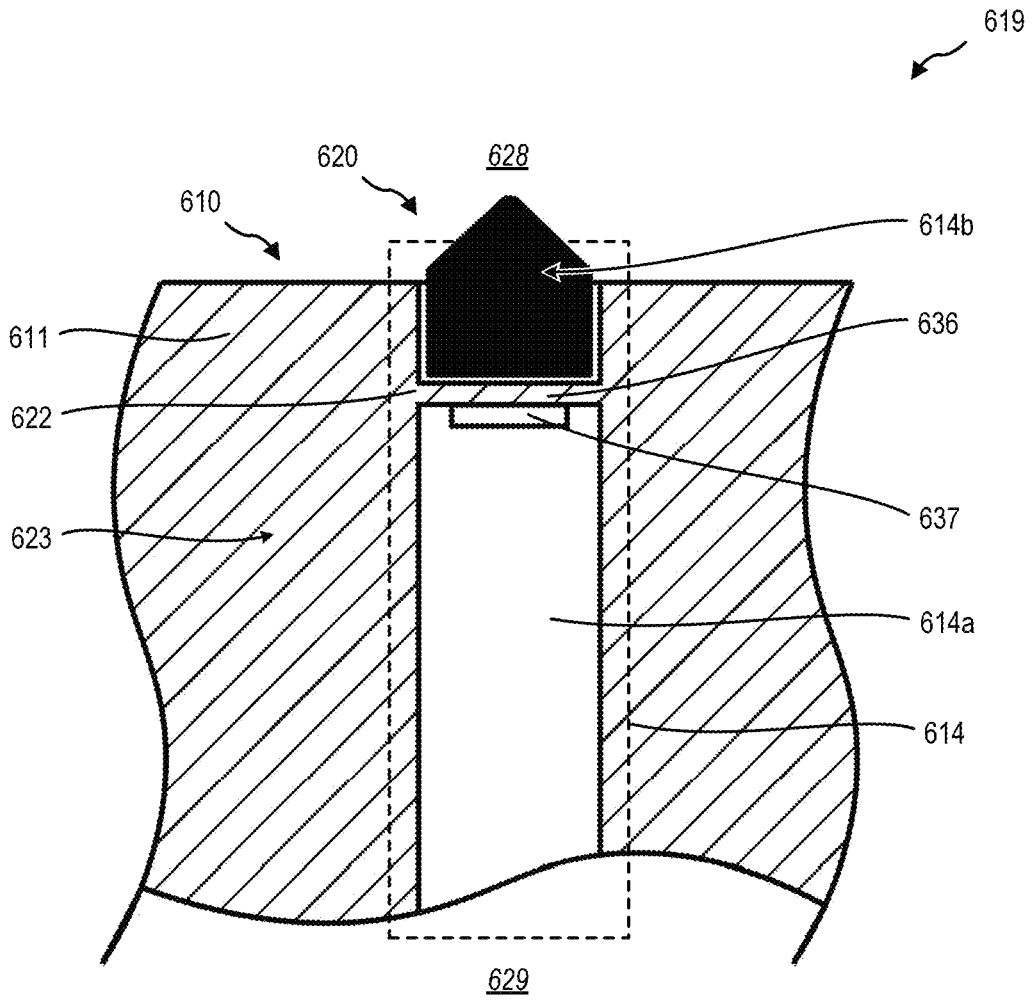
FIG. 6 is a side view of a bit, according to at least one embodiment of the present disclosure.

FIG. 6 is a side cross-section view of an instrument assembly 619, according to at least one embodiment of the present disclosure. The instrumentation assembly 619 may include an electronics housing 614 formed in the body 611 of a bit 610. The instrument assembly 619 may include an engagement element assembly 620. The engagement element assembly 620 may connect to the electronics housing 614, for example, at an engagement element pocket of the electronics housing 614. The engagement element assembly 620 may include a sensor engagement element for engaging an earth formation. The engagement element assembly 620 may include an engagement element housing for connecting the engagement element to the electronics housing, or the engagement element assembly may connect directly to the electronics housing without an engagement element housing.

In some embodiments, the instrumentation assembly 619 may include a diaphragm. The diaphragm may be integrally formed in the body 611 of the bit 610. For example, the electronics housing 614 may be formed and/or defined by a proximal cavity 614*a* penetrating and/or extending into the bit body 611 from a proximal side 629 of the bit body 611, and a distal cavity 614*b* penetrating and/or extending into the bit body 611 from a distal side 628 of the bit body 611. The proximal cavity 614*a* and the distal cavity 614*b* may not meet or join such that there is not a through-hole in the bit body 611, but a small and/or thin portion of the bit body 611 may remain and/or separate the proximal cavity 614*a* and distal cavity 614*b* to form the diaphragm 636. The proximal cavity 614*a* and distal cavity 614*b* may each be included as part of the electronics housing 614 (e.g., the proximal cavity 614*a* and distal cavity 614*b* may define the electronics housing 614). The distal cavity may be an engagement element pocket of the electronics housing 614, such as the engagement element pocket 417 of FIG. 4-1.

The instrument assembly 619 may be configured such that the diaphragm 636 is positioned at a base of the engagement element assembly 620. In this way, forces may be transmitted through the engagement element assembly and to the diaphragm 636. The diaphragm 636 may experience one or more dynamics (or changes in dynamic) based on the forces transmitted from the engagement element assembly such as force, stress, strain, pressure, deflection, deformation, displacement, or any other resulting dynamic (and combinations thereof). For example, the diaphragm may be configured to deflect and/or deform to at least some degree based on forces transmitted to the diaphragm from the engagement element assembly 620. The diaphragm may be configured to support the engagement element assembly 620 and/or the forces from the engagement element assembly 620 without breaking, becoming deformed, or otherwise undergoing plastic deformation. In some embodiments the instrument assembly 619 may include a strain gauge 637. The strain gauge 637 may be positioned on the diaphragm, for example, in the proximal cavity 614*a* of the electronics housing 614. The strain gauge may sense or measure one or more of the dynamics (or changes in dynamics) of the diaphragm (e.g., based on a deformation and/or deflection of the diaphragm). In this way, the strain gauge 637 and the diaphragm 636 may form a sensor 623. The sensor 623 may sense and/or take measurements corresponding to an engagement of the engagement element assembly 620 with the earth formation. In some embodiments, the engagement element assembly 620 may remain substantially axially fixed in response to the forces experienced by the engagement element assembly 620. In this way, the sensor 623 may take measurements based on an elastic deformation and/or a measurable change in at least one dimension of at least a portion of the diaphragm (e.g., as opposed to an axial movement or displacement of the engagement element assembly 620).

In some embodiments, the diaphragm 636 may form a seal 622 (or may be the seal 622). For example, due to the integral nature of the diaphragm 636 with the bit body 611, the proximal cavity 614*a* may be sealed from the distal cavity 614*b* and/or from an exterior of the bit 610 by the diaphragm 636. The diaphragm 636 and/or seal 622 may seal the proximal cavity 614*a* from an exterior pressure (e.g., a downhole pressure) and/or may prevent pressure and/or fluid from penetrating into and/or out of the proximal cavity 614*a*. This may help to protect the strain gauge 637 (and associated electronics positioned in the proximal cavity 614*a*) from exposure to one or more properties of the downhole environment that may cause damage to these components. In this way, the diaphragm 636 may be the seal 622 and may seal at least a portion of the electronics housing (e.g., from a downhole pressure and/or fluid penetration). In some embodiments, the diaphragm 636 may be the seal 322 of FIG. 3.

Figure 7:
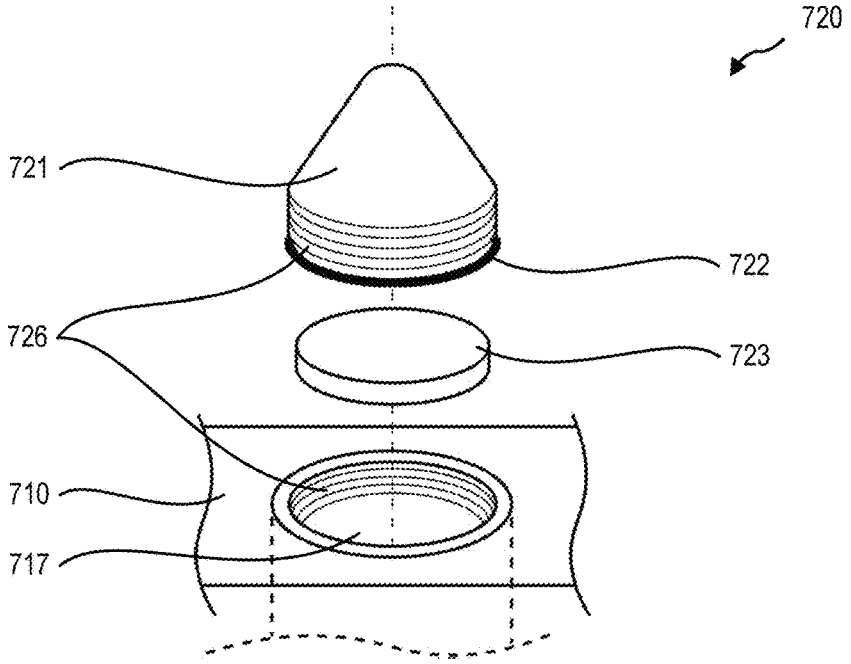
FIG. 7 is an exploded partial view of an engagement element assembly, according to at least one embodiment of the present disclosure.

FIG. 7 is an exploded view of an engagement element assembly 720, according to at least one embodiment of the present disclosure. In some embodiments, the engagement element assembly 720 includes a sensor engagement element 721. The sensor engagement element 721 may connect to a bit 710 via an engagement element pocket 717. As discussed herein, the engagement element pocket 717 may be part of or connected to an electronics housing conduit or may be included in the bit 710 as a separate component from the electronics housing conduit.

In some embodiments the sensor engagement element 721 is connected to or retained in the engagement element pocket 717 through a direct engagement with the engagement element pocket 717. For example, the sensor engagement element 721 may be connected to the engagement element pocket by a connector. The connector may be threads 726. In this way, the sensor engagement element 721 may thread and be tightened into the engagement element pocket 717 in order to secure the sensor engagement element 721 to the bit 710.

In some embodiments, the engagement element assembly 720 includes a seal 722. The seal 722 may be positioned between the sensor engagement element 721 and the engagement element pocket 717. In this way, the seal 722 may seal the engagement element pocket 717, for example, from the environment external to the bit 710. In some embodiments, an electronics housing conduit is connected to the engagement element pocket 717 and the seal 722 seals the electronics housing conduit. In some embodiments, the seal prevents fluid from penetrating into the engagement element pocket 717. In some embodiments, the seal maintains a pressure within the engagement element pocket. This may facilitate including electronics and/or the sensor 723 in the bit 710 by protecting these components from the harsh downhole environment.

In some embodiments, the seal 722 is an O-ring seal. For example, the sensor engagement element 721 may include an outer groove around its exterior. The seal 722 may seat in the groove and in this way maintain its position between the sensor engagement element 721 and the engagement element pocket 717. In some embodiments, the seal 722 is included in the engagement element pocket 717 (e.g., by an inner groove around an interior of the engagement element pocket 717). In some embodiments, the seal 722 is a gasket seal. For example, the sensor engagement element 721 may include a flange, and a gasket seal may be positioned between the flange of the sensor engagement element 721 and an upper surface of the engagement element pocket 717, which may seal the engagement element pocket 717 when tightened. In some embodiments, the seal 722 is created by sealing surfaces of the sensor engagement element 721 and the engagement element pocket 717 without an O-ring, gasket, or other dedicated sealing component. For example, the sealing surfaces may be tightened against each other such that the seal 722 is formed. In this way, the engagement element pocket 717 (and/or an electronics housing conduit) may be sealed from one or more aspects of the downhole environment.

As mentioned above, the engagement element assembly 720 may include a sensor 723. The sensor 723 may be an engagement sensor configured to take measurements corresponding with an engagement of the sensor engagement element 721 with a borehole. The sensor 723 may be a force sensor. For example, the sensor 723 may be a force transducer, load cell, strain gauge, or combinations thereof, and may take one or more force measurements. The sensor 723 may be any other type of sensor for taking any other downhole measurement, as described herein. The sensor 723 may be inserted into the engagement element pocket 717 underneath and/or before the sensor engagement element 721. The sensor 723 may be positioned in the sealed portion of the engagement element pocket 717, and in this way may be protected from the drilling environment. The sensor may be positioned at a base of the sensor engagement element 721. As discussed herein, the sensor engagement element 721 may engage a downhole earth formation which may exert a force on the sensor engagement element 721. This force may be transferred through the sensor engagement element 721 and to the sensor 723. For example, one or more features (e.g., in the engagement element pocket 717) may support the sensor 723, and the sensor engagement element 721 may press against, or exert a force on, the sensor 723. In this way, the sensor 723 may take engagement measurements corresponding to and engagement of the sensor engagement element 721 with the borehole, such as force measurements corresponding to an axial force exerted on the sensor engagement element 721. In some embodiments, the sensor is connected to or included on the sensor engagement element 721. For example, the sensor 723 may be a strain gauge, and may be connected to a base of the sensor engagement element 721, such as will be discussed herein in connection with FIGS. 11-15.

The sensor engagement element 721 may be fixed with respect to the engagement element pocket 717. For example, the sensor engagement element 721 may be fixed such that the force exerted on the sensor engagement element 721 may not cause the sensor engagement element 721 to move, for example, axially with respect to the engagement element pocket 717. The sensor engagement element 721 may exert a force onto the sensor 723 without the sensor engagement element moving axially with respect to the sensor 723. For example, the sensor 723 may include a strain gauge, and the sensor 723 may sense parameters associated with the force (e.g., force, deformation, pressure, deflection, displacement, etc.) by sensing a strain caused by the sensor engagement element 721. This may be in contrast to, for example, a sensor which may employ a mechanical means such as a spring and/or a linkage to sense a force associated with a movement of the sensor engagement element 721. In this way, the sensor engagement element 721 may be fixed axially with respect to the engagement element pocket 717 in order to securely retain the sensor engagement element 721. In some embodiments, the sensor engagement element 721 is not axially fixed with respect to the engagement element pocket 717. For example, the sensor 723 may include a mechanical means for taking measurements (e.g., measuring force with a spring) and the sensor engagement element 721 may be free to axially move, to at least some degree, within the engagement element pocket 717. In this way the sensor 723 may take measurements associated with the sensor engagement element 721 based on a movement of the sensor engagement element 721. In some embodiments, one or more sensors are connected to one or more other components of the BHA. In some embodiments, the one or more sensors include a transmitter to transmit sensor data. For example, the transmitter may transmit sensor data to other components of the BHA. In another example, the transmitter may transmit sensor data to the surface.

Figure 8:
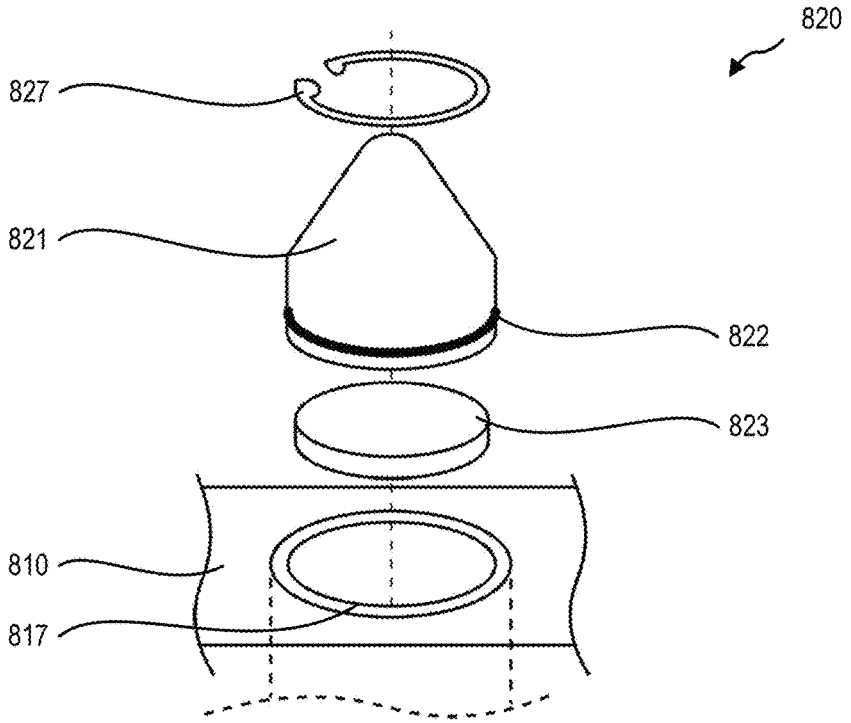
FIG. 8 is an exploded partial view of an engagement element assembly, according to at least one embodiment of the present disclosure.

FIG. 8 is an exploded view of an engagement element assembly 820, according to at least one embodiment of the present disclosure. In some embodiments, the engagement element assembly 820 includes a sensor engagement element 821. The sensor engagement element 821 may connect to a bit 810 via an engagement element pocket 817. As discussed herein, the engagement element pocket 817 may be part of or connected to an electronics housing conduit or may be included in the bit 810 as a separate component from the electronics housing conduit.

In some embodiments, the sensor engagement element 821 is connected to or retained in the engagement element pocket 817 through a direct engagement with the engagement element pocket 817. For example, the sensor engagement element 821 may insert directly into the engagement element pocket 817 and may be connected to the engagement element pocket 817 by a connector. The connector may be a circlip 827. For example, the engagement element pocket 817 may include an interior groove and the circlip 827 may be inserted into the interior groove by compressing the circlip 827. An inner diameter of the circlip 827 seated in the interior groove may be less than an outer diameter of the sensor engagement element 821. In this way, the circlip 827 may be inserted into the engagement element pocket 817 on top of or after the sensor engagement element 821 to retain the sensor engagement element 821 in the engagement element pocket 817. In some embodiments, the sensor engagement element 821 is axially fixed with respect to the engagement element pocket 817, such as that discussed above in connection with FIG. 7.

In some embodiments, the engagement element assembly 820 includes a seal 822. The seal 822 may be the seal 722 of FIG. 7, and/or may include one or more features of the seal 722 of FIG. 7. The seal 822 may be positioned between the sensor engagement element 821 and the engagement element pocket 817 and, in this way may seal the engagement element pocket 817 from the environment external to the bit 810. In some embodiments, the engagement element assembly 820 includes a sensor 823, such as the sensor 723 discussed above in connection with FIG. 7.

Figure 9:
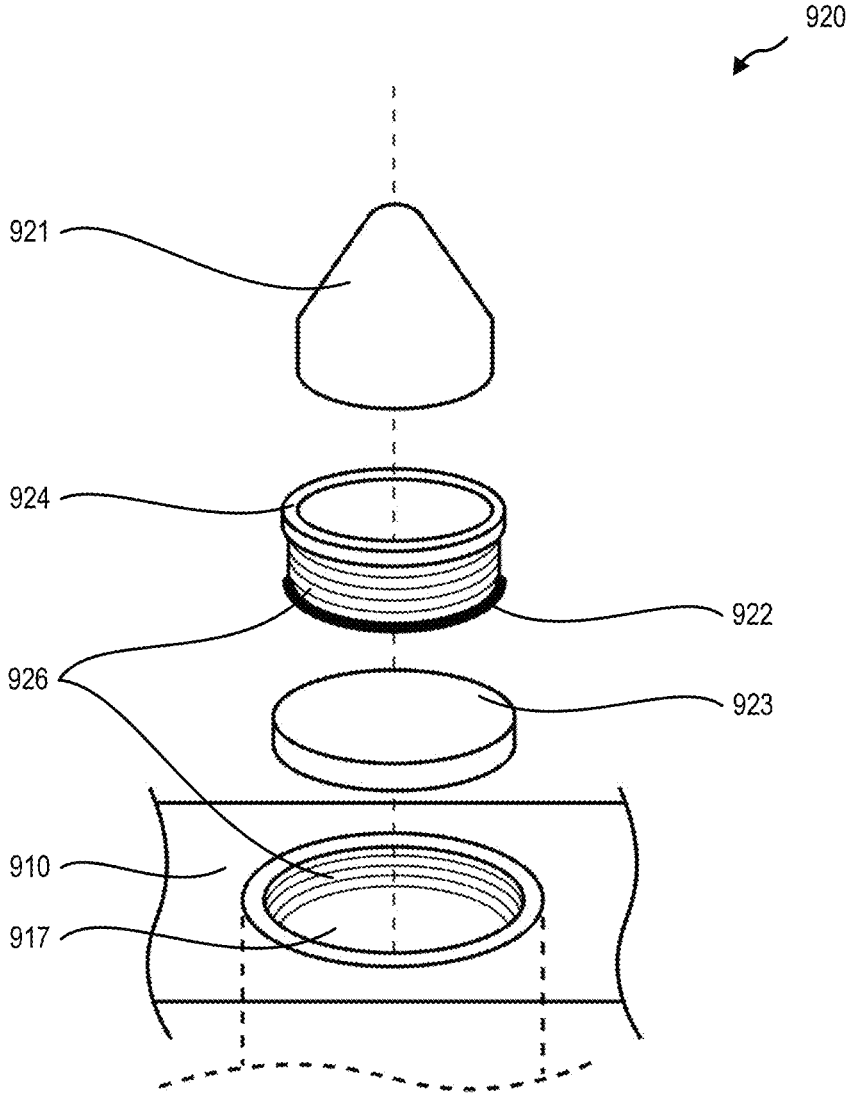
FIG. 9 is an exploded partial view of an engagement element assembly, according to at least one embodiment of the present disclosure.

FIG. 9 is an exploded view of an engagement element assembly 920, according to at least one embodiment of the present disclosure. In some embodiments, the engagement element assembly 920 includes a sensor engagement element 921. The sensor engagement element 921 may connect to a bit 910 via an engagement element pocket 917. As discussed herein, the engagement element pocket 917 may be part of or connected to an electronics housing conduit or may be included in a bit 910 as a separate component from the electronics housing conduit.

In some embodiments, the sensor engagement element 921 is connected to or retained in the engagement element pocket 917 through an indirect engagement with the engagement element pocket 917. For example, the sensor engagement element 921 may be connected to or contained in an engagement element housing 924, and the engagement element housing 924 may be connected to the engagement element pocket 917. The engagement element housing 924 will be discussed herein in detail in connection with FIGS. 11-15. In some embodiments, the engagement element housing 924 is connected to the engagement element pocket 917 by a connector. The connector may be threads 926. In this way, the engagement element housing 924 may thread and be tightened into the engagement element pocket 917 in order to secure the sensor engagement element 921 to the bit 910. The sensor engagement element 921 may be connected to the engagement element housing 924 by any suitable means, including permanent (or semi-permanent) means. For example, the sensor engagement element 921 may be brazed, glued, pressed, threaded, or fastened into the engagement element housing 924. In some embodiments, the sensor engagement element 921 is axially fixed with respect to the engagement element pocket 917, such as that discussed above in connection with FIG. 7.

In some embodiments, the engagement element assembly 920 includes a seal 922. The seal 922 may include one or more features of the seal 722 of FIG. 7. The seal 922 may be positioned between the engagement element housing 924 and the engagement element pocket 917 and, in this way may seal the engagement element pocket 917 from the environment external to the bit 910. In some embodiments, the engagement element assembly 920 includes a sensor 923, such as the sensor 723 discussed above in connection with FIG. 7.

Figure 10:
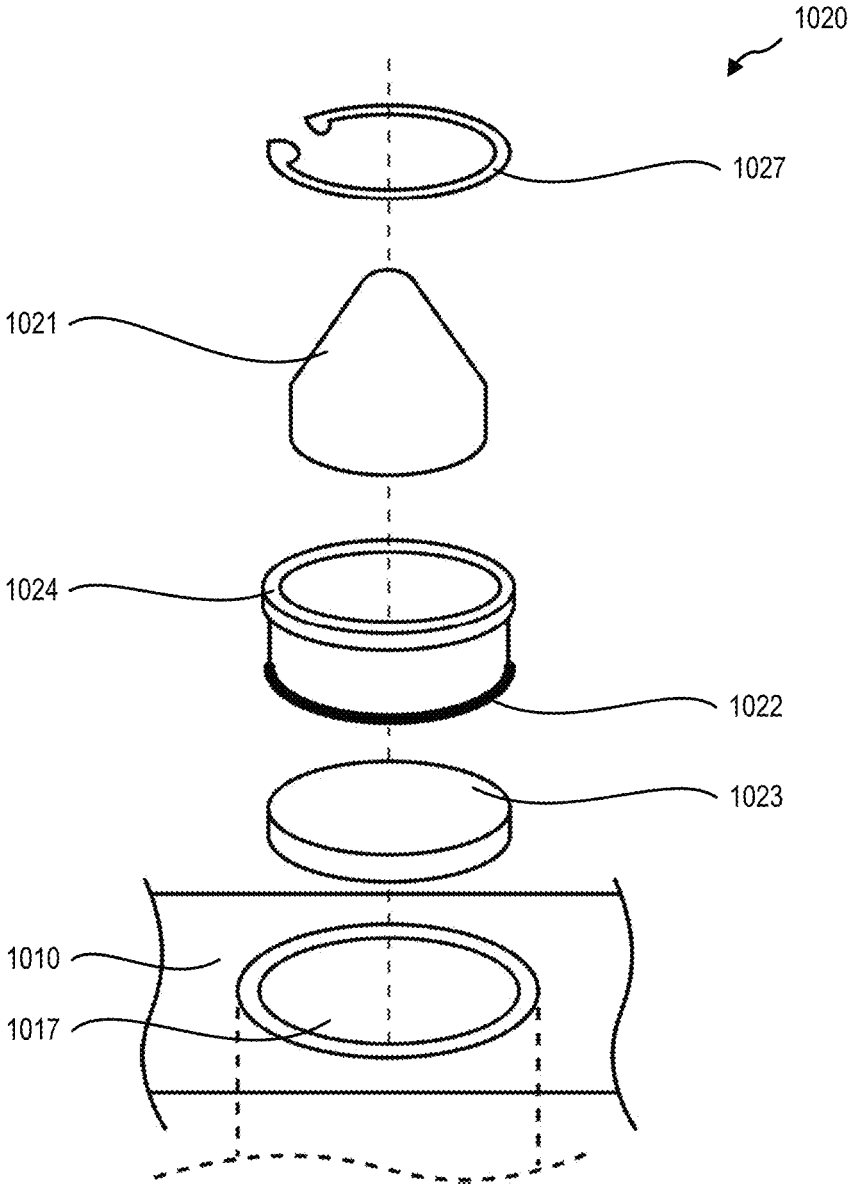
FIG. 10 is an exploded partial view of an engagement element assembly, according to at least one embodiment of the present disclosure.

FIG. 10 is an exploded view of an engagement element assembly 1020, according to at least one embodiment of the present disclosure. In some embodiments, the engagement element assembly 1020 includes a sensor engagement element 1021. The sensor engagement element 1021 may connect to a bit 1010 via an engagement element pocket 1017. As discussed herein, the engagement element pocket 1017 may be part of or connected to an electronics housing conduit or may be included in a bit 1010 as a separate component from the electronics housing conduit.

In some embodiments, the sensor engagement element 1021 is connected to or retained in the engagement element pocket 1017 through an indirect engagement with the engagement element pocket 1017. For example, the sensor engagement element 1021 may be connected to or contained in an engagement element housing 1024, and the engagement element housing 1024 may be connected to the engagement element pocket 1017. The engagement element housing may include one or more features of the engagement element housing 924 of FIG. 9. The engagement element housing 1024 will be discussed herein in detail in connection with FIGS. 11-15. In some embodiments, the engagement element housing 1024 is connected to the engagement element pocket 1017 by a connector. The connector may be a circlip 1027. The circlip 1027 may include one or more features of the circlip 827 of FIG. 8. In this way, the circlip 1027 may retain the engagement element housing 1024 in the engagement element pocket 1017. In some embodiments, the sensor engagement element 1021 is axially fixed with respect to the engagement element pocket 1017, such as that discussed above in connection with FIG. 7.

In some embodiments, the engagement element assembly 1020 includes a seal 1022. The seal 1022 may include one or more features of the seal 722 of FIG. 7. The seal 1022 may be positioned between the engagement element housing 1024 and the engagement element pocket 1017 and in this way may seal the engagement element pocket 1017 from the environment external to the bit 1010. In some embodiments, the engagement element assembly 1020 includes a sensor 1023, such as the sensor 723 discussed above in connection with FIG. 7.

In this way, the various embodiments of the sensor engagement element described in connection with FIGS. 7-10 may be removably connected to the engagement element pocket through a mechanical connection. This may facilitate including and/or replacing the sensor engagement element and/or electronics associated with the sensor engagement element. For example, the electronics may be inserted into the engagement element pocket (e.g., into an electronics housing conduit connected to the engagement element pocket) after which the engagement element assembly may be installed into the engagement element pocket. In another example, the electronics may be housed in another location, and wiring from the electronics may extend into the engagement element pocket where they may be connected to a sensor of the engagement element assembly before the assembly is installed into the engagement element pocket. In this way, the electronics may receive downhole measurements from the sensor. The removable connection of the engagement element assembly may also facilitate including electronics such as the sensor in the engagement element assembly (e.g., in an electronics housing) without exposing the electronics to temperatures which may damage the electronics, such as through brazing of the engagement element.

Figure 11:
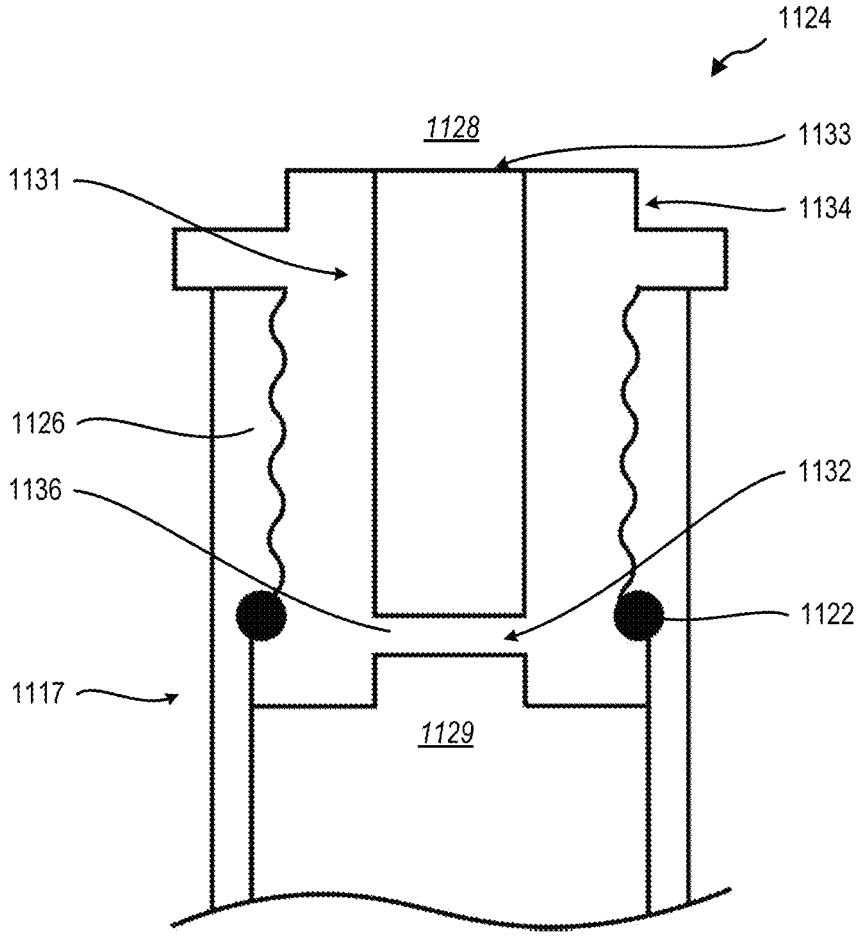
FIG. 11 is a side cutaway view of an engagement element housing, according to at least one embodiment of the present disclosure.

FIG. 11 is a side cutaway view of an instrumentation housing or an engagement element housing 1124, according to at least one embodiment of the present disclosure. The engagement element housing 1124 includes a housing body configured to connect to an engagement element pocket 1117 of a downhole tool. The housing body may have a distal end 1128 and a proximal end 1129. The proximal end 1129 may insert into and/or engage with the engagement element pocket 1117. The housing body may connect to the engagement element pocket 1117 such that the distal end 1128 is positioned at an outer surface of the downhole tool. The distal end 1128 positioned on the outer surface of the downhole tool may facilitate a measurement by one or more sensors associated with the engagement element housing 1124.

In some embodiments, the housing body removably connects to the engagement element pocket 1117. For example, the housing body may include threads 1126. The threads 1126 may be exterior threads on an outer surface of the housing body. The threads 1126 may thread or screw into interior threads on an inner surface of the engagement element pocket 1117. In another example, the housing body may removably connect to the engagement element pocket 1117 with a circlip, such as that described in connection with FIGS. 7-10. The housing body may include a tightener 1134. The tightener 1134 may facilitate securing and/or tightening the connecting of the housing body to the engagement element pocket 1117. For example, the tightener 1134 may be a hex head tightener. The tightener 1134 may be a Phillips, flat, star, TORX, TORX pin, square, spline, slotted, any other tightener, or any other suitable means for tightening the connection of the housing body to the engagement element pocket 1117. The housing body may include a flange. The flange may seat against a surface of the engagement element pocket 1117, for example, to tighten the housing body in the engagement element pocket 1117.

In some embodiments, the engagement element housing 1124 has a seal 1122. The seal 1122 may be positioned on an exterior of the housing body such that the seal 1122 is positioned between the housing body and the engagement element pocket 1117 (e.g., when the engagement element housing 1124 is connected to the engagement element pocket 1117). The seal 1122 may help to seal a portion of the engagement element pocket 1117 (and/or an electronics housing conduit). For example, the seal 1122 may seal a pressure in the engagement element pocket 1117 and/or may prevent fluid or other matter from penetrating into the engagement element pocket 1117. In some embodiments, such as that shown, the seal 1122 is an O-ring seal. The O-ring may seat in a groove or channel on an exterior of the housing body. In some embodiments, the O-ring seats in a groove or channel on the interior of the engagement element pocket 1117. In this way, the O-ring may be positioned between the housing body and the engagement element pocket 1117 to seal the engagement element pocket 1117. In some embodiments, the seal 1122 is a gasket. For example, the gasket may be disposed on the flange. In some embodiments, the gasket is disposed on a mating surface of the engagement element pocket 1117. The gasket may be positioned between the flange and a surface of the engagement element pocket 1117 to seal the engagement element pocket 1117. In some embodiments, the seal 1122 is created without a distinct, or dedicated sealing element. For example, mating surfaces of the housing body and the engagement element pocket 1117 may interface to form the seal 1122 (e.g., the flange and a surface of the engagement element pocket 1117). In this way, the engagement element housing 1124 may form a removable connection with the bit, and may also seal, for example, an electronics housing conduit of the bit.

In some embodiments, the engagement element housing 1124 includes a measurement pocket 1131. The measurement pocket 1131 may be formed in the housing body. The measurement pocket 1131 may define a cavity or conduit in the housing body. For example, the measurement pocket 1131 may have a pocket base 1132 and a pocket opening 1133. The pocket base 1132 and pocket opening 1133 may be on opposite ends of the measurement pocket 1131. In some embodiments, the pocket opening 1133 is on the distal end 1128 of the housing body. In some embodiments, the pocket opening 1133 is on the proximal end 1129 of the housing body. The measurement pocket 1131 may be configured to house one or more sensors for taking one or more downhole measurements. For example, the pocket base 1132 may include or may define a diaphragm 1136. A strain gauge may be connected to the pocket base 1132 at the diaphragm 1136. The strain gauge and/or the diaphragm 1136 may facilitate measuring, for example, a force and/or pressure associated with an operation of the bit. For example, the diaphragm 1136 may experience or exhibit a strain due to a pressure or a force acting on the diaphragm 1136. The strain gauge may measure the corresponding strain. In this way, the downhole measurement may include force measurements and/or pressure measurements. In another example, a temperature sensor may be positioned in the measurement pocket for measuring a temperature (e.g., taking temperature measurements) associated with the bit. In this way, the engagement element pocket 1117 may facilitate including instrumentation in a bit for taking one or more downhole measurements including force measurements, pressure measurements, and temperature measurements, among others.

The engagement element housing 1124 may be at least partially made of one or more wear-resistant materials. For example, the engagement element housing 1124 may include tungsten carbide, a polycrystalline diamond compact (PDC), high-speed steel, ceramics, nickel alloys, any other suitable wear resistance material, and combinations thereof. In some embodiments, one or more portions of the engagement element housing 1124 are made of or coated with a wear-resistant material. The wear resistant properties of the engagement element housing 1124 may facilitate exposing at least a portion of the engagement element housing 1124 to the conditions of the borehole (e.g., at an outer surface of the bit). In this way, the engagement element housing 1124 may withstand the harsh downhole drilling environment in order that the engagement element housing 1124 may be incorporated in any number of downhole locations and with any number of downhole tools.

Figure 12:
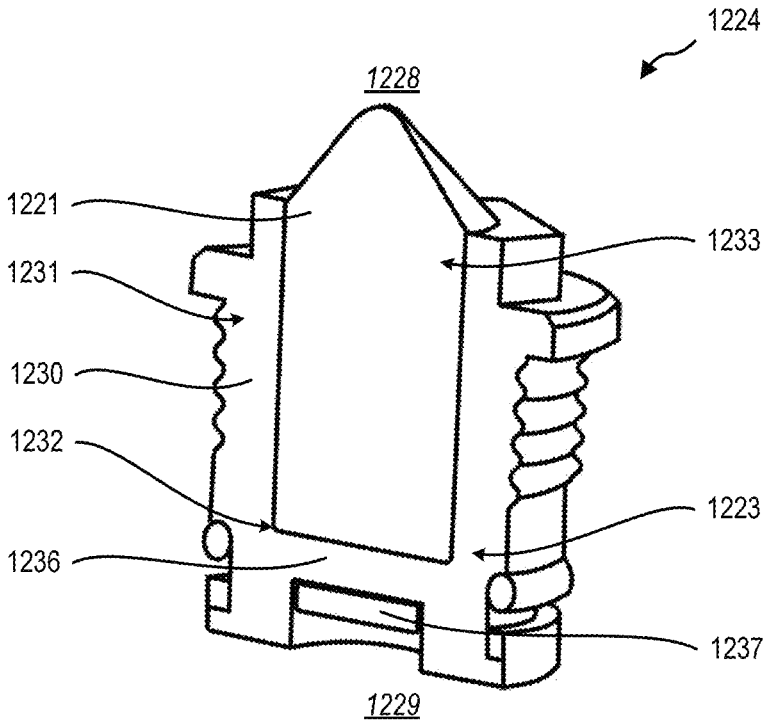
FIG. 12 is a side cutaway view of an engagement element housing, according to at least one embodiment of the present disclosure.

FIG. 12 is a side cutaway view of an engagement element housing 1224, according to at least one embodiment of the present disclosure. In some embodiments, a sensor engagement element 1221 is disposed or retained in an engagement element housing 1224. The engagement element housing 1224 may include a housing body 1230 having a distal end 1228 and a proximal end 1229. The sensor engagement element 1221 may be any type of engagement element, such as a planar engagement element, a non-planar (e.g., conical, hemispherical, bullet, etc.) engagement element such as a Stinger engagement element, a rolling engagement element or any other engagement element. The sensor engagement element 1221 may be an engagement element, or an element that is not configured to or not primarily intended to cut, such as a steering or stabilizing pad. The sensor engagement element 1221 may be positioned in a measurement pocket 1231. For example, the sensor engagement element 1221 may be inserted into, at least partially, a cavity defined by the measurement pocket 1231. The sensor engagement element 1221 may extend out of a pocket opening 1233. The pocket opening 1233 may be positioned on the distal end 1228 of the housing body 1230 such that the sensor engagement element 1221 extends outward from an outer surface of a downhole tool (e.g., a bit). In this way, the sensor engagement element 1221 may be configured to extend from the bit in order to engage the borehole.

The sensor engagement element 1221 may be connected to or retained in the measurement pocket 1231. For example, the sensor engagement element 1221 and/or the measurement pocket 1231 may each have a groove or channel. A retainer (e.g., a circlip) may be positioned in the corresponding grooves, for example, upon installation of the sensor engagement element 1221 to retain the sensor engagement element 1221 in the measurement pocket 1231. The sensor engagement element 1221 may be connected to or retained in the measurement pocket 1231 by any other suitable means. For example, the sensor engagement element 1221 may be glued, brazed, pressed, threaded, or fastened in the measurement pocket 1231. In this way, the sensor engagement element 1221 may be removably connected to the housing body 1230.

The sensor engagement element 1221 may be retained in the measurement pocket 1231 such that the sensor engagement element 1221 is axially fixed. For example, the sensor engagement element 1221 may be fixed such that the sensor engagement element 1221 may not move relative to its longitudinal axis during engagement with the borehole. This may facilitate transferring a force through the sensor engagement element 1221 and to the sensor 1223, as discussed herein. In some embodiments, the sensor engagement element 1221 is axially fixed but may be free to spin or rotate within the measurement pocket 1231. This may facilitate continually exposing different portions of a revolving cutting face in order to reduce wear of the sensor engagement element 1221.

In some embodiments, a pocket base 1232 of the measurement pocket 1231 includes or defines a diaphragm 1236. The diaphragm 1236 may be positioned at a base of the sensor engagement element 1221. As the sensor engagement element 1221 engages the borehole, a force (e.g., an axial force) may be transmitted through the sensor engagement element 1221 to the diaphragm 1236. For example, in some embodiments, the sensor engagement element 1221 is retained in the measurement pocket 1231 such that forces exerted on the sensor engagement element 1221 are not distributed throughout the housing body 1230. Rather, in some embodiments, the sensor engagement element 1221 is retained in the measurement pocket such that forces exerted on the sensor engagement element 1221 are directed and/or transmitted through a base of the sensor engagement element 1221 to the diaphragm 1236. The diaphragm 1236 may experience or exhibit a strain corresponding to at least a portion of the force (e.g., the axial force).

The strain of the diaphragm 1236 may be due to a material compliance of the diaphragm 1236. In some embodiments, the diaphragm 1236 has a diaphragm thickness of 10 mm. In some embodiments, the diaphragm thickness is in a range having an upper value, a lower value, or upper and lower values including any of 1 mm, 2 mm, 3 mm, 4 mm, 5 mm, 6 mm, 7 mm, 8 mm, 9 mm, 10 mm, 15 mm, 20 mm, or any value therebetween. For example, the diaphragm thickness may be less than 20 mm. In another example, the diaphragm thickness may be greater than 1 mm. In yet another example, the diaphragm thickness may be between 1 mm and 20 mm. In some embodiments, it is critical that the diaphragm thickness be between 3 mm and 6 mm to ensure that the diaphragm 1236 exhibits a measurable level of strain, while preventing plastic deformation of the diaphragm 1236 due to the axial forces.

In some embodiments, a sensor 1223 is housed by the measurement pocket 1231. For example, a strain gauge 1237 may be disposed on the diaphragm 1236. The strain gauge 1237 may measure a strain exhibited by the diaphragm 1236, for example, based on forces exerted on the sensor engagement element 1221. In this way, the sensor engagement element 1221, the diaphragm 1236, and the strain gauge 1237 may form the sensor 1223 (e.g., an engagement sensor). In some embodiments, the strain gauge 1237 is disposed on an opposite side of the diaphragm 1236 from the sensor engagement element 1221. In this way, the strain gauge 1237 may be positioned in the sealed portion of an engagement element pocket (and/or an electronics housing conduit). This may facilitate incorporating the strain gauge 1237 and/or associated electronics in the bit as no wire path is required to pass through from the sealed portion of the engagement element pocket to an unsealed portion of the engagement element pocket.

Figure 13:
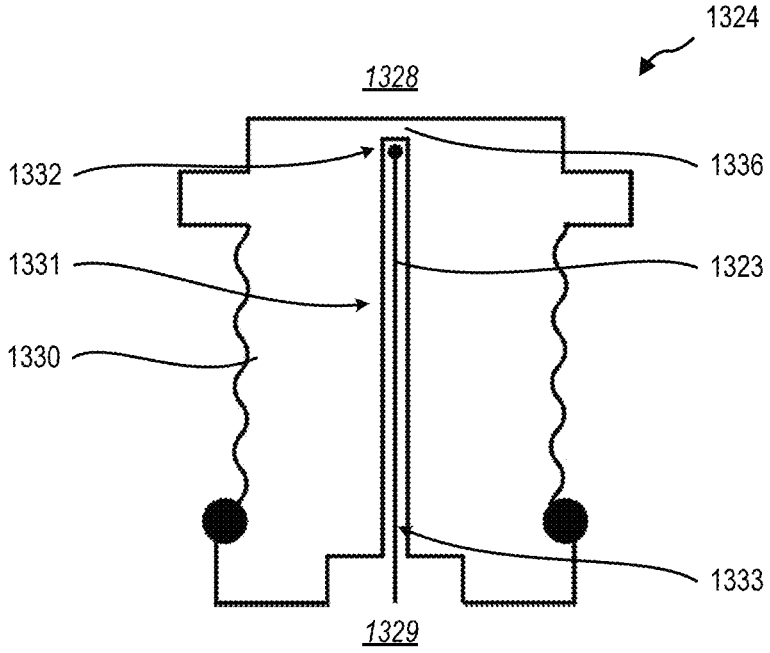
FIG. 13 is a side cutaway view of an engagement element housing, according to at least one embodiment of the present disclosure.

FIG. 13 is a side cutaway view of an engagement element housing 1324, according to at least one embodiment of the present disclosure. In some embodiments, the engagement element housing 1324 includes a housing body 1330 having a measurement pocket 1331. In some embodiments, a pocket opening 1333 is positioned on a proximal end 1329 of a housing body 1330. In this way, the measurement pocket 1331 may open or face a sealed portion of an engagement element pocket, such as the engagement element pocket 1117 of FIG. 11. A sensor 1323 may be housed by the measurement pocket 1331 in this manner by extending directly from (e.g., wires extending from) the sealed portion of the engagement element pocket. This may facilitate connecting the sensor 1323 to electronics (e.g., a processor and/or a power source) housed in the engagement element pocket (and/or an electronics housing conduit) to receive downhole measurements from the sensor.

In some embodiments, the sensor 1323 is a temperature sensor such as a thermocouple. The pocket base 1332 may be positioned at a distal end 1328 of the housing body 1330. In this way, the sensor 1323 may be positioned or extend to just below the distal end 1328 of the housing body 1330, facing a borehole. The pocket base 1332 oriented in this way may facilitate the sensor 1323 (e.g., a temperature sensor) taking accurate measurements at the exterior surface of a bit, while still being protected in the sealed portion of an engagement element pocket (such as engagement element pocket 1117 of FIG. 11). For example, a heat experienced by the bit may transfer through the pocket base 1332 and to the sensor 1323. The pocket base 1332 may be thick enough to resist wear and protect the sensor 1323, but thin enough to effectively transfer heat through to the sensor 1323. In this way, the pocket base 1332 may be a diaphragm 1336 for transferring heat. In some embodiments, the pocket base 1332 and/or diaphragm 1336 is made, either partially or entirely, of a material with a high thermal conductivity. For example, the pocket base 1332 may include a diamond disc. In some embodiments, a thermal paste is disposed in the measurement pocket 1331 to facilitate heat being conducted to the sensor 1323. In this way, the pocket base 1332 and/or the diaphragm 1336 may be resistive to wear while effectively conducting heat to the sensor 1323.

Figure 15:
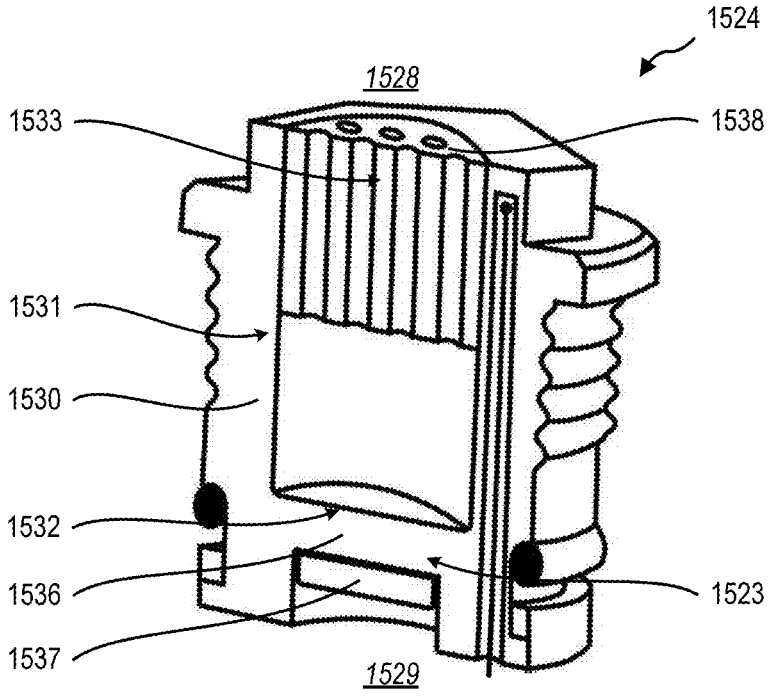
FIG. 15 is a side cutaway view of an engagement element housing, according to at least one embodiment of the present disclosure.

In some embodiments the measurement pocket 1331 is formed in a side portion or a side wall of the housing body 1330, (such as is shown in FIG. 15). This may be as an alternative to or in addition to a measurement pocket 1331 formed in another portion (e.g., a central portion) of the housing body 1330. The measurement pocket 1331 in this manner may extend at least partially along the side of and/or parallel to an additional measurement pocket 1331 in another portion of the housing body 1330. In this way, any number of techniques for including instrumentation in the bit in conjunction with an engagement element housing may be combined to include any number of sensors for taking downhole measurements associated with the bit and/or the formation.

Figure 14:
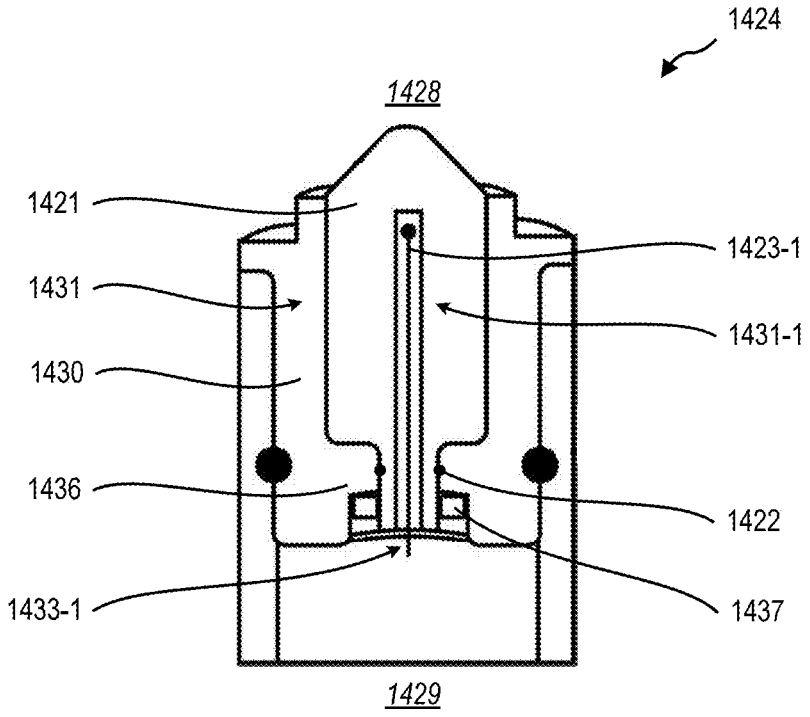
FIG. 14 is a side cutaway view of an engagement element housing, according to at least one embodiment of the present disclosure.

FIG. 14 is a side cutaway view of an engagement element housing 1424, according to at least one embodiment of the present disclosure. In some embodiments, the engagement element housing 1424 includes a housing body 1430 having a proximal end 1429 and a distal end 1428. In some embodiments, the engagement element housing 1424 includes a measurement pocket 1431-1 for housing one or more sensors. In some embodiments, the measurement pocket 1431-1 is formed in a sensor engagement element 1421. In some embodiments, this is in addition to a measurement pocket 1431 formed, for example, in a housing body 1430 of the engagement element housing 1424 in which the sensor engagement element 1421 is inserted. A pocket opening 1433-1 may be at a proximal end 1429 of the sensor engagement element 1421 and may face a sealed portion of an engagement element pocket (such as engagement element pocket 1117 of FIG. 11). In this way, the measurement pocket 1431-1 may extend upward, at least partially through the sensor engagement element 1421. The measurement pocket 1431-1 in this manner may house a sensor 1423-1 such as a temperature sensor. The measurement pocket 1431-1 may be configured such that the sensor 1423-1 is positioned adjacent or toward a distal end 1428 of the sensor engagement element 1421 in order that the sensor 1423-1 may measure a temperature at or near an engagement point of the sensor engagement element 1421 with a borehole. In this way, the sensor 1423-1 may take an accurate reading of the temperature experienced and/or exhibited by the sensor engagement element 1421.

In some embodiments, the sensor engagement element 1421 extends through a diaphragm 1436 of the housing body 1430. For example, the diaphragm 1436 may include an inner bore, and a stem of the sensor engagement element 1421 may extend through the inner bore of the diaphragm 1436. This may facilitate the measurement pocket 1431-1 connecting or opening to the sealed portion of the engagement element pocket. To this end, the sensor engagement element 1421 and/or the housing body 1430 may include one or more additional seals 1422. These seals 1422 may seal the inner bore of the diaphragm 1436 in order to seal the engagement element pocket as described herein. In some embodiments, the engagement element housing 1424 includes a strain gauge 1437. The strain gauge 1437 may include two or more strain gauges positioned around the inner bore of the diaphragm 1436. In some embodiments, the strain gauge 1437 includes a strain gauge that is at least partially circular or round, and the strain gauge 1437 may be positioned at least partially (or entirely) around the inner bore of the diaphragm 1436.

FIG. 15 is a side cutaway view of an engagement element housing 1524, according to one or more embodiments of the present disclosure. In some embodiments, the engagement element housing 1524 includes a housing body 1530 having a distal end 1528 and a proximal end 1529. In some embodiments, the engagement element housing 1524 includes a measurement pocket 1531. In some embodiments, the measurement pocket 1531 will not include a sensor engagement element housed therein. This may be an alternative to or in addition to a measurement pocket 1531 housing a sensor engagement element. A pocket base 1532 of the measurement pocket 1531 and a diaphragm 1536 may be positioned at a proximal end 1529 of the housing body 1530. The pocket opening 1533 may be positioned at a distal end 1528, opening to an exterior of a bit or to a borehole. In this way, the diaphragm 1536 (including a strain gauge 1537 positioned on the diaphragm 1536) may form a sensor 1523 (e.g., a pressure sensor). For example, in some situations, fluid present in the borehole (e.g., air, drilling fluid, etc.) may enter the measurement pocket 1531 and may exert pressure on the diaphragm 1536. The diaphragm 1536 may accordingly experience and/or exhibit strain, which may be measured by the strain gauge 1537. This may facilitate measuring a pressure present in the borehole and/or a pressure experienced by the bit.

In some embodiments, a mud filter 1538 is positioned in the measurement pocket 1531. The mud filter 1538 may prevent the measurement pocket 1531 from becoming clogged such as with drilling mud, or any other particulate present in the borehole. For example, the mud filter 1538 may span the pocket opening 1533 and may include one or more holes. The holes may allow fluid and smaller particles to flow into and/or out of the measurement pocket 1531 but may prevent mud and/or larger particles from entering the measurement pocket 1531. In this way, the mud filter 1538 may prevent packing off of particulates above the sensor 1523 (e.g., above the diaphragm 1536). This may ensure that the sensor 1523 can take an accurate measurement of the downhole pressure.

The various embodiments of the engagement element housing described herein in connection with FIGS. 11-15 may include any number of measurement pockets with sensors therein. In some embodiments, the engagement element housing includes 1, 2, 3, 4, 5, or more measurement pockets with sensors for taking any number of downhole measurements. For example, the engagement element housing may include one or more measurement pockets with a distal pocket opening, such as for measuring force or pressure as described herein, and/or may also include one or more measurement pockets with a proximal pocket opening, such as for measuring temperature as described herein. One or more sensors in addition to those described above may be implemented in conjunction with the engagement element housing having measurement pockets as described herein. For example, in addition to temperature sensors, pressure sensors, and axial force sensors, the engagement element housing may include gyroscopes, accelerometers, 2 and 3 axis force sensors, light sensors, sound sensors, sensors for measuring electrical properties, any other sensor for taking measurements relevant to drilling and/or the borehole, and combinations thereof. In this way, the techniques described herein in connection with the various embodiments of the engagement element housing described herein may be combined in any number of combinations to include any number of instrument configurations in the bit for taking downhole measurements. In some embodiments, one or more sensors are connected to one or more other components of the BHA. In some embodiments, the one or more sensors include a transmitter to transmit sensor data. For example, the transmitter may transmit sensor data to other components of the BHA. In another example, the transmitter may transmit sensor data to the surface.

Figure 16:
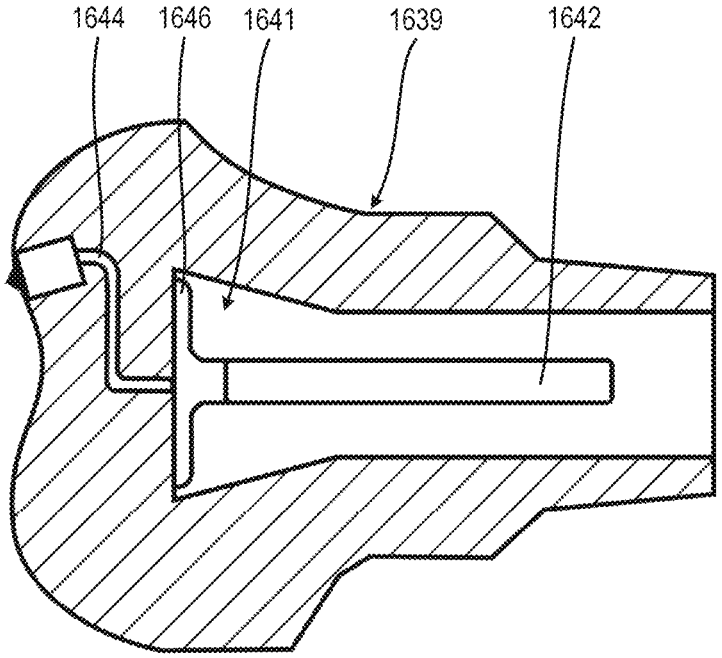
FIG. 16 is a side cutaway view of an electronics housing system implemented in connection with a downhole tool, according to at least one embodiment of the present disclosure.

FIG. 16 is a side cutaway view of an electronics housing system implemented in connection with a downhole tool 1639, according to at least one embodiment of the present disclosure. In some embodiments, the downhole tool 1639 is a downhole bit for lengthening a borehole. In some embodiments, the electronics housing system is implemented in connection with any other downhole tool in accordance with that discussed herein.

In some embodiments, the electronics housing system includes an electronics housing 1642. The electronics housing 1642 may be positioned within the downhole tool 1639. For example, the electronics housing 1642 may be at least partially positioned inside of an inner bore 1641 of the downhole tool 1639. The electronics housing may be positioned at any other location and in any other portion of the downhole tool 1639. The electronics housing 1642 may house electronics, for example, associated with a sensor of the downhole tool 1639, such as an instrumented engagement element assembly as discussed herein.

In some embodiments, the electronics housing system includes a wire conduit 1644. The wire conduit 1644 may help to route or direct one or more wires. For example, the downhole tool 1639 may include one or more sensors, and the wire conduit 1644 may route wires from the sensors at least partially through a body of the downhole tool 1639. This may facilitate connecting electronics in the electronics housing 1642 to the one or more sensors.

In some embodiments, the electronics housing system includes an electronics housing adapter, or an adapter 1646. The adapter 1646 may be positioned within the inner bore 1641. The adapter 1646 may connect to the electronics housing 1642 and/or the wire conduit 1644. The adapter 1646 in this manner may facilitate a connection of the wire conduit 1644 and the electronics housing 1642, for example, in order to pass one or more wires from the wire conduit 1644 to the electronics housing 1642. The adapter may form one or more sealed connections with the electronics housing 1642 and/or the wire conduit 1644. In this way, the adapter 1646 may facilitate connecting and sealing a wire path from pressure and/or fluid penetration.

Figures 1, 17:
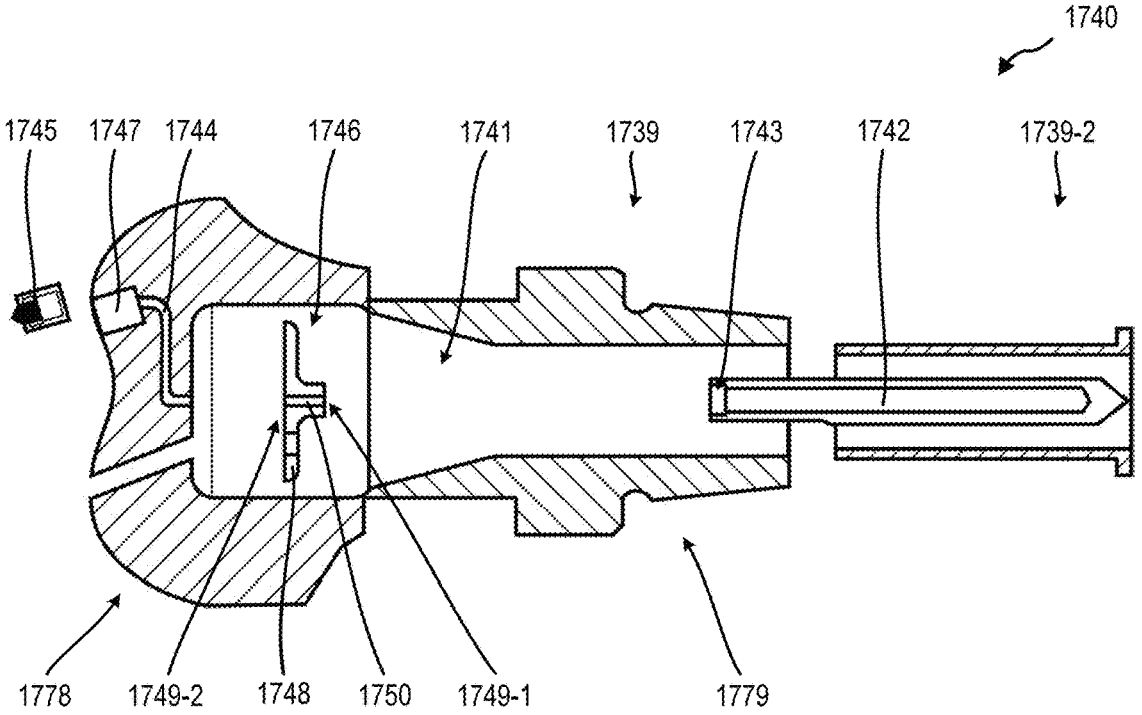
Figures 2, 17:
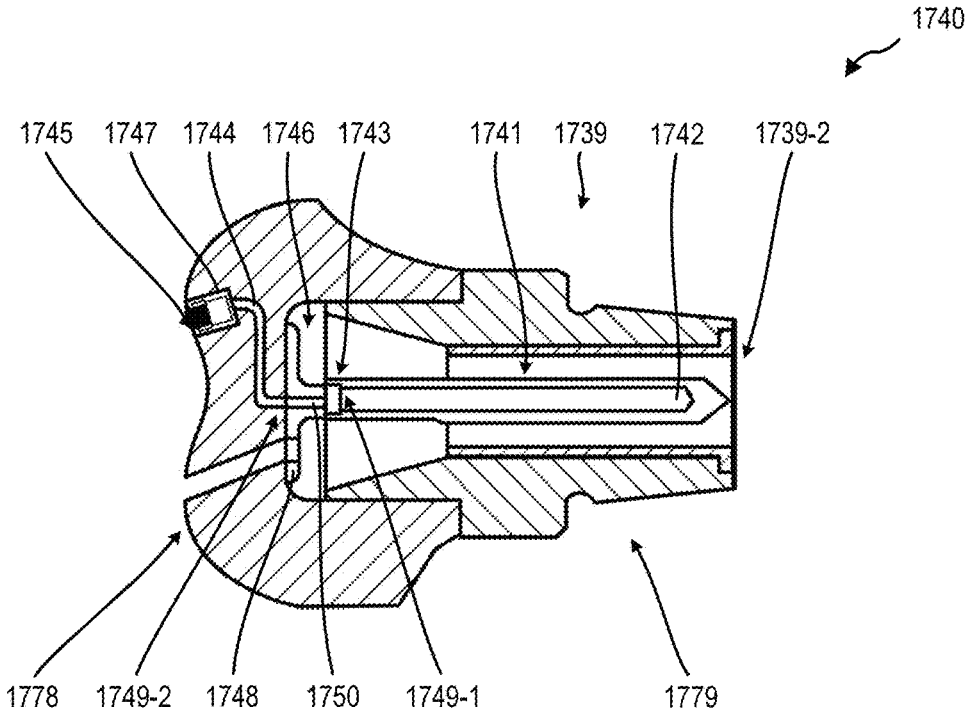

FIG. 17-1 is an exploded side cutaway view and FIG. 17-2 is an assembled side cutaway view of an electronics housing system implemented in connection with a downhole tool 1739, according to at least one embodiment of the present disclosure.

In some embodiments, the electronics housing system 1740 includes an electronics housing 1742. The electronics housing 1742 may be a conduit (such as the conduit 415 of FIG. 4-1), passage, enclosure, etc. configured to house electronics. For example, the electronics may be associated with one or more sensors positioned at one or more locations with respect to the downhole tool 1739. The electronics housing 1742 may be a synapse housing of a downhole tool (e.g., modified to engage with an adapter 1746 as will be described herein in detail). In some embodiments, the electronics housing 1742 has an elongate shape. For example, the electronics housing 1742 may be substantially cylindrical in shape. This may facilitate the electronics housing 1742 being positioned within the inner bore 1741. In another example, the electronics housing 1742 may be polygonal in cross section. This may facilitate a desired orientation in the inner bore 1741. In some embodiments, the electronics housing 1742 is oriented in a longitudinal direction of the downhole tool 1739. For example, the electronics housing 1742 may be substantially parallel to a longitudinal axis and/or axis of rotation of the downhole tool 1739. In some embodiments, the electronics housing 1742 is positioned at a center of the downhole tool 1739. For example, the electronics housing 1742 may be concentric with the downhole tool 1739 and/or a longitudinal axis of the electronics housing 1742 may be positioned along the longitudinal axis of the downhole tool 1739. This may facilitate balancing a rotation of the downhole tool 1739. This may also facilitate a fluid flow through the inner bore 1741 as will be described herein.

The electronics housing 1742 may include an opening 1743. The opening 1743 may facilitate inserting and/or connecting electronics housed in the electronics housing 1742 (e.g., as discussed herein in connection with the conduit 415 of FIG. 4-1). For example, one or more wires may pass through the opening 1743 in order to connect the electronics to one or more sensors. In accordance with at least one embodiment of the present disclosure, the opening 1743 may be oriented in a downhole direction and/or may face a downhole end of the downhole tool 1739. This may facilitate implementing sensors at or near an outer surface at the downhole end of the downhole tool 1739.

In some embodiments, the electronics housing 1742 is at least partially positioned or positionable within the inner bore 1741 of the downhole tool 1739. For example, the inner bore 1741 may be a fluid passage. In some situations, a flow of drilling fluid continually or periodically passes through the inner bore 1741 to facilitate one or more functions of the downhole tool 1739. The electronics housing 1742 may be sealed in order to prevent the drilling fluid from penetrating into the electronics housing 1742. For example, the opening 1743 may connect to and seal with one or more components, as will be described herein, in order to seal the electronics housing 1742. In some embodiments, the electronics housing 1742 is configured to withstand pressures within the inner bore 1741. For example, in some situations, the flow of drilling fluid is under pressure (e.g., to provide pressurized fluid to one or more nozzles of the drilling tool). In some situations, the downhole tool 1739 and/or the inner bore 1741 experiences and/or exhibits increased atmospheric pressures due to the downhole environment. The electronics housing 1742 may be configured to withstand these pressures, for example, without collapsing and/or failing. The electronics housing 1742 may seal (e.g., at the opening 1743) to prevent a loss of pressure within the electronics housing 1742. For example, the electronics housing 1742 may be sealed with a surface atmospheric pressure, and the electronics housing 1742 (and the opening 1743) may seal the surface pressure within the electronics housing 1742. In this way, the electronics housing 1742 positioned within the inner bore 1741 may be exposed to fluids and/or pressures associated with drilling activities and may prevent exposure of the electronics within the electronics housing 1742 to these fluids and/or pressures.

In some embodiments, the electronics housing 1742 is connected to and/or included as part of the downhole tool 1739. In some embodiments, the electronics are connected to and/or included as part of a second downhole tool 1739-2 and/or are positionable within the inner bore 1741 of the downhole tool 1739, for example, through a connection of the downhole tool 1739 with the second downhole tool 1739-2. For example, the second downhole tool 1739-2 may be located above or uphole of the downhole tool 1739 and may connect directly or indirectly (e.g., through one or more additional downhole tools and/or drilling components) to the downhole tool 1739 such that the electronics housing 1742 is positioned (or positionable) at least partially within the downhole tool 1739 (e.g., in the inner bore 1741). This may facilitate implementing the electronics housing 1742 by including the electronics housing 1742 within existing tools and/or components of the drilling system. In some embodiments, the second downhole tool 1739-2 is a section of drill pipe. The second downhole tool 1739-2 may be any other downhole tool or component of the drilling system as described herein.

In some embodiments, the downhole tool 1739 includes one or more sensors 1745 for taking one or more downhole measurement. For example, the sensor 1745 may be an instrumented engagement element assembly as described herein. The sensor 1745 may be an engagement sensor, force sensor, pressure sensor, temperature sensor, gyroscope, accelerometer, light sensor, speed sensor, depth sensor, sound sensor, sensor for measuring electrical properties, any other sensor for taking relevant downhole measurement, and combinations thereof. In some embodiments, the sensor 1745 is implemented at or near an outer surface of the downhole tool 1739. The sensor 1745 may be implemented at or near a downhole end of the downhole tool 1739. The sensor 1745 may be connected to an engagement element pocket 1747 of the downhole tool 1739, such as the engagement element pocket 1747 described herein. The sensor 1745 may connect to the engagement element pocket 1747. For example, the sensor 1745 may removably connect to the engagement element pocket 1747 as described herein. The sensor 1745 may connect to the engagement element pocket 1747 with a sealed connection. For example, the sealed connection of the engagement element pocket 1747 may prevent a pressure and/or fluid from penetrating past the sealed connection and/or into (or out of) the engagement element pocket.

As mentioned above, the electronics housing system 1740 includes a wire conduit 1744. The wire conduit 1744 may be a passage or path to direct one or more wires associated with the sensor 1745. The wire conduit 1744 may extend at least partially through a body of the downhole tool 1739. For example, the wire conduit 1744 may connect to the engagement element pocket 1747 at a first end and/or may connect to the inner bore 1741 at a second end. In this way, the wire conduit 1744 may provide a wire path for one or more sensor wires to travel from the engagement element pocket 1747 to the inner bore 1741, and, as will be described herein, to the electronics housing 1742. This may facilitate including electronics associated with the sensor 1745 at distinct locations from the sensor 1745 in the downhole tool 1739 and/or the drilling system.

As mentioned above, the electronics housing system 1740 includes an adapter 1746. The adapter 1746 may include an adapter body 1748. The adapter body 1748 may be configured to connect to the downhole tool 1739. For example, the adapter body 1748 may connect to an inner portion of the downhole tool 1739 or at the inner bore 1741. The adapter body 1748 may connect to the downhole tool 1739 with a removable connection. For example, the adapter body 1748 may be bolted, screwed, threaded, or pressed onto the downhole tool, or any other suitable means of connection. In accordance with at least one embodiment of the present disclosure, the adapter body 1748 may be configured to connect to a head 1778 of the downhole tool 1739. For example, the downhole tool 1739 may be a bit, and the adapter body 1748 may connect to the head 1778 of the bit. The adapter body 1748 may connect to the head 1778 at an inner portion or inner bore of the head 1778. The head 1778 may be at a downhole portion of the bit. In some embodiments, the downhole tool 1739 includes a shank 1779. The shank 1779 may connect to the head 1778, for example, for connecting the downhole tool 1739 to a drill pipe (or additional downhole tool). The adapter body 1748 may be positioned between the head 1778 and the shank 1779 of the downhole tool 1739. For example, the adapter body 1748 may connect to the head 1778 of the bit between a connection of the head 1778 and the shank 1779. The positioning of the adapter 1746 in this way may facilitate an assembling of the downhole tool 1739 with the electronics housing system 1740 implemented therein, as will be discussed herein.

In some embodiments, the adapter body 1748 connects with any downhole tool. For example, the adapter body 1748 may connect to the downhole tool 1739 through features that are already included or are generic to existing downhole tools. In another example, the adapter body 1748 may connect to the downhole tool 1739 through slight modifications to an existing downhole tool. In this way, the adapter 1746 may be implemented and/or retrofitted into existing downhole tools without the need for buying, creating, or manufacturing specialty downhole tools to implement the adapter 1746. This may facilitate including the electronics housing system 1740 in connection with any downhole tool.

The adapter body 1748 may connect to the downhole tool 1739 and may at least partially span the inner bore 1741 (e.g., an inner diameter of the inner bore 1741). In some embodiments, the adapter body 1748 includes one or more holes and/or fluid passages. For example, the adapter body 1748 (e.g., when connected to the downhole tool 1739) may at least partially cover or block one or more fluid conduits of the downhole tool 1739. The fluid passages in the adapter body 1748 may allow fluid to pass through to the fluid conduits of the downhole tool 1739, for example to provide a fluid flow to one or more nozzles (e.g., at an outer surface of the downhole tool 1739). One or more features may be included for orienting the adapter body 1748 in order to align the fluid passages of the adapter body 1748 (and/or align the connection of the adapter body 1748 with the electronics housing 1742 and/or the wire conduit 1744 as will be described herein). For example, the adapter body 1748 and/or the downhole tool 1739 may include one or more dowels, pins, grooves, notches, or markings to facilitate correctly aligning the adapter body 1748 in the inner bore 1741. The adapter body 1748 having fluid passages may facilitate implementing the adapter with existing downhole tools (e.g., as a retrofit) without the need to change or alter the downhole tool.

In some embodiments, the adapter 1746 includes a first connector 1749-1. The first connector 1749-1 may be a connector configured to connect with the electronics housing 1742. For example, the first connector 1749-1 may connect at the opening 1743 of the electronics housing 1742. In this way, the adapter 1746 may connect to the electronics housing 1742 to form a first connection. The first connection may be a first sealed connection. For example, the electronics housing 1742 (e.g., the opening 1743) and/or the first connector 1749-1 may include and/or form a seal. The seal may be an O-ring seal, a gasket seal, sealing surfaces, or combinations thereof. The first sealed connection may prevent pressure from penetrating and/or escaping the electronics housing 1742. The first sealed connection may prevent fluid from penetrating into the electronics housing 1742. For example, the drilling fluid in the inner bore 1741 may not penetrate into the electronics housing 1742 through the first sealed connection. In some embodiments, the first sealed connection is a removable connection. In this way, the adapter 1746 may facilitate creating a sealed volume in the electronics housing 1742.

In some embodiments, the adapter 1746 includes a second connector 1749-2. The second connector 1749-2 may be a connector configured to connect to the wire conduit 1744. For example, the second connector 1749-2 may connect to the wire conduit 1744 at a point where the wire conduit 1744 extends into the inner bore 1741. In this way, the adapter 1746 may connect to the wire conduit 1744 to form a second connection. The second connection may be a second scaled connection. For example, the wire conduit 1744 and/or the second connector 1749-2 may include and/or form a seal. The seal may be an O-ring seal, a gasket seal, sealing surfaces, or combinations thereof. The second sealed connection may prevent pressure from penetrating and/or escaping the wire conduit 1744. The second sealed connection may prevent fluid from penetrating into the wire conduit 1744. In some embodiments, the second sealed connection is a removable connection. For example, the drilling fluid in the inner bore 1741 may not penetrate into the wire conduit 1744 through the second sealed connection.

In some embodiments, the adapter 1746 has a wire passage 1750. The wire passage 1750 may be a hole or bore through the adapter body 1748, for example, from the first connector 1749-1 to the second connector 1749-2. The wire passage 1750 may connect the wire conduit 1744 to the electronics housing 1742. In this way one or more wires from the sensor 1745 may pass through the wire conduit 1744, through the adapter 1746 and to the electronics housing 1742. As described herein, the adapter 1746 may form sealed connections with the wire conduit 1744 and the electronics housing 1742. In this way, the engagement element pocket 1747, the wire conduit 1744, the adapter 1746 (e.g., the wire passage 1750) and the electronics housing 1742 may all be connected and sealed. This may create one continuous sealed volume from the engagement element pocket 1747 to the electronics housing 1742. This may facilitate including and/or connecting the sensor 1745 and electronics in the drilling system and/or the downhole tool 1739 by protecting these components from exposure to fluids and/or pressures that may damage them. In this way, implementing the adapter 1746 may facilitate including the electronics housing 1742 and/or electronics in the electronics housing 1742 at a distinct location from the sensor 1745 (e.g., without the electronics housing 1742 being directly connected to the engagement element pocket 1747 and/or the sensor 1745).

This may facilitate implementing multiple sensors 1745 at multiple locations in the downhole tool 1739 and/or the drilling system while having one, central electronics housing 1742. For example, a plurality of wire conduits 1744 may connect with the adapter 1746 to implement a plurality of sensors 1745 and/or engagement element pockets 1747. The adapter 1746 may be configured to connect to a plurality of electronics housings 1742. The electronics housing 1742 being remote from the sensor 1745 may facilitate varying configurations of the sensor 1745. For example, the sensor 1745 may be configured, positioned, or oriented in a way such that it may be difficult to locate or house accompanying electronics adjacent or close to the sensor 1745.

As mentioned above, the one or more components of the electronics housing system 1740 may be removably connected with or to one or more other components. This may facilitate an assembly of the downhole tool 1739 implementing the electronics housing system 1740. For example, assembly of the downhole tool 1739 may include first installing and/or connecting the adapter 1746 in a head 1778 of the downhole tool 1739 (e.g., in an inner bore of the head 1778). A seal such as an O-ring may be included prior to installation to create the seal between the adapter 1746 and the wire conduit 1744. The adapter 1746 may be installed and/or connected by aligning one or more alignment features (such as dowel pins) in order to align the fluid passages and/or wire passage of the adapter 1746. A shank 1779 of the downhole tool 1739 may then be installed and/or connected to the head 1778. The shank 1779 may be connected with the head 1778 through a threaded connection, and the threaded connection may be torqued. This threaded connection may at least partially help to connect or maintain a connection of the adapter 1746 to the downhole tool 1739. Wires may be fed from the sensor 1745, through the engagement element pocket 1747, the wire conduit 1744, the adapter 1746, and into the electronics housing 1742. In some embodiments, the wires (e.g., from the sensor 1745) are fed through the electronics housing. For example, the electronics housing may have an end cap at an opposite end from the opening 1743, and the wires may (e.g., temporarily) pass through an entirety of the electronics housing to facilitate installation and/or assembly. The sensor may then be installed in the downhole tool 1739. For example, the sensor 1745 may be an instrumented cutting assembly that is installed and/or connected to the engagement element pocket 1747. The second downhole tool 1739-2 may then be connected to the downhole tool 1739, such as through a threaded connection. The connection of the second downhole tool 1739-2 to the downhole tool 1739 may cause an engagement and/or connection of the electronics housing 1742 with the adapter 1746. A seal such as an O-ring may be installed at the connection of the adapter 1746 with the electronics housing 1742 as part of the connection of the second downhole tool 1739-2 with the downhole tool 1739. The electronics associated with the sensor 1745 may then be situated in the electronics housing 1742, and the endcap installed. In some embodiments, the electronics are situated as part of the connection of the second downhole tool 1739-2 with the downhole tool 1739 (e.g., in embodiments where the electronics housing 1742 doesn't include an endcap). In this way, the downhole tool 1739 may be assembled in order to implement the electronics housing system 1740.

Figure 18:
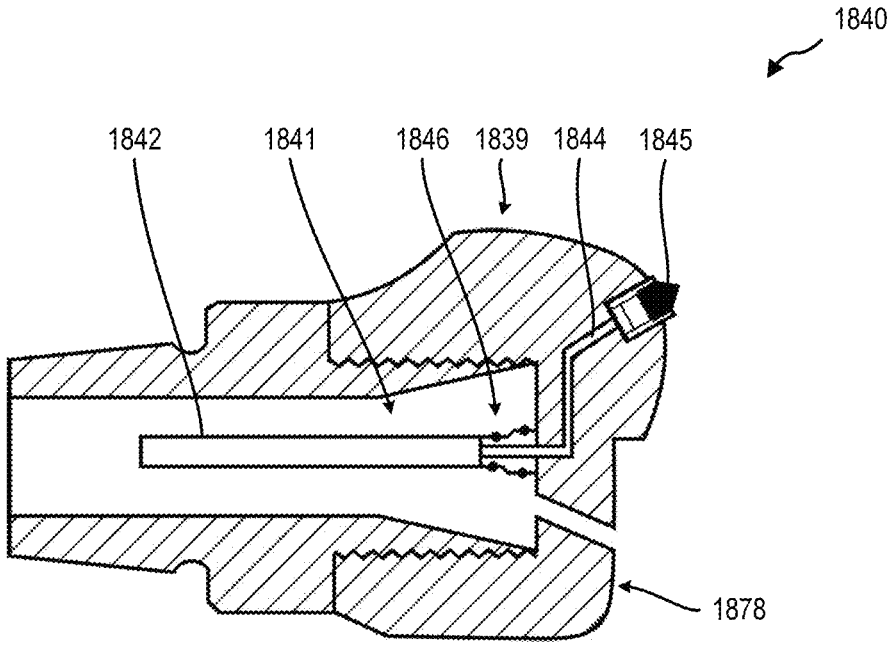
FIG. 18 is a side cutaway view of an electronics housing system implemented in connection with a downhole tool, according to at least one embodiment of the present disclosure.

FIG. 18 is a side cutaway view of an electronics housing system 1840 implemented in connection with a downhole tool 1839, according to at least one embodiment of the present disclosure. As discussed herein, the electronics housing system 1840 may include one or more of an electronics housing 1842, an adapter 1846, a wire conduit 1844, and a sensor 1845.

In some embodiments, the adapter 1846 is part of the downhole tool 1839. For example, the adapter 1846 with the features described herein in connection with FIGS. 16 to 17-2 may be integrally formed into the body of the downhole tool 1839. For example, the adapter 1846 may be cast, machined, milled, additively manufactured, otherwise formed in the body of the downhole tool 1839, or combinations thereof. The adapter 1846 may be integrally formed on a head 1878 of the downhole tool 1839. In some embodiments, the adapter 1846 extends from the head 1878 of the downhole tool 1839. For example, one or more features of the adapter 1846 may extend from the body of the downhole tool 1839 into an inner bore 1841 of the downhole tool 1839. In some embodiments, the adapter 1846 extends into the body of the downhole tool 1839. For example, one or more features of the adapter 1846 may be recessed into the head 1878 of the downhole tool 1839. The adapter 1846 may be integrally formed in the body of the downhole tool 1839 in this way to facilitate including the electronics housing system 1840 in the downhole tool 1839, for example, by simplifying the system with less parts and/or connections. This may also facilitate assembly of the downhole tool 1839 implementing the electronics housing system 1840.

As described herein, the electronics housing 1842 may be positionable in the inner bore 1841 of the downhole tool 1839. The adapter 1846 being integrally formed with the downhole tool 1839 may engage and/or connect with the electronics housing 1842 in the same manner as that described above in connection with FIGS. 16 to 17-2. For example, the electronics housing 1842 may be included in a second downhole tool and may be positionable in the inner bore 1841 of the downhole tool 1839 to engage and/or connect with the adapter in connection with or as a result of the second downhole tool connecting with the downhole tool 1839. In some embodiments, the electronics housing 1842 is not included in or associated with the second downhole tool. For example, the electronics housing 1842 may connect to and or be supported by an engagement of the electronics housing 1842 with the adapter 1846, and in this way the electronics housing 1842 may be positionable within the inner bore 1841 of the downhole tool 1839. This may further simplify the electronics housing system 1840 and/or simplify assembly of the downhole tool 1839 and/or BHA.

Figure 19:
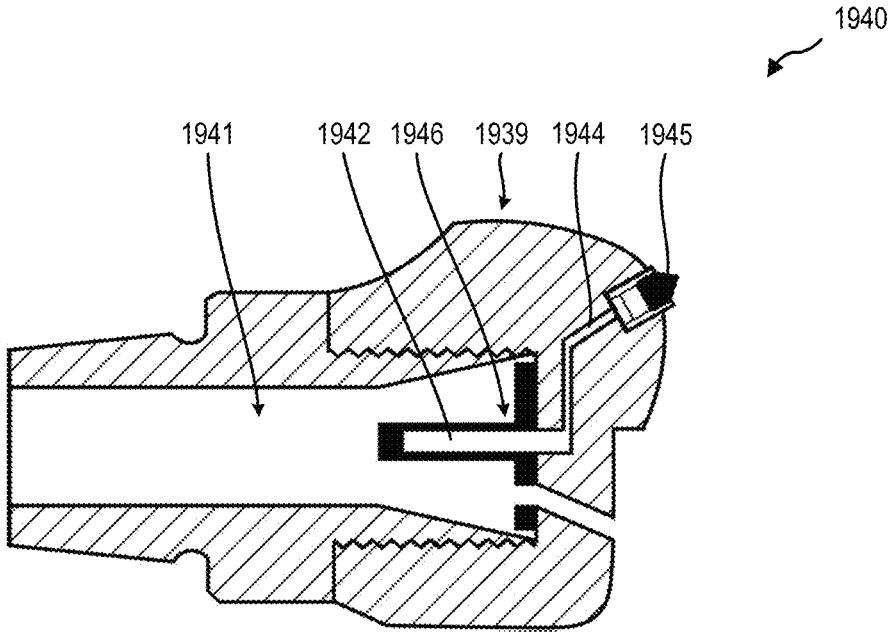
FIG. 19 is a side cutaway view of an electronics housing system implemented in connection with a downhole tool, according to at least one embodiment of the present disclosure.

FIG. 19 is a side cutaway view of an electronics housing system 1940 implemented in connection with a downhole tool 1939, according to at least one embodiment of the present disclosure. As discussed herein, the electronics housing system 1940 may include one or more of an electronics housing 1942, an adapter 1946, a wire conduit 1944, and a sensor 1945.

In some embodiments, the electronics housing 1942 is part of the adapter 1946. For example, the electronics housing 1942 may be integrally formed with the adapter 1946. In this way, the electronics housing 1942 may be positionable within the inner bore 1941 of the downhole tool 1939 by connecting the adapter 1946 with the downhole tool 1939. This may facilitate implementing the electronics housing system 1940 by simplifying the electronics housing system 1940 (e.g., with fewer parts) and/or simplifying assembly of the downhole tool 1939. For example, electronics may be situated in the electronics housing 1942, for example, as part of an installation of the adapter 1946. The adapter 1946 having the electronics housing integral to the adapter 1946 may include one or more features discussed above in connection with FIGS. 16 to 17-2. For example, the adapter 1946 may include fluid passages to provide a flow of drilling fluid through the body of the downhole tool 1939.

Figure 20:
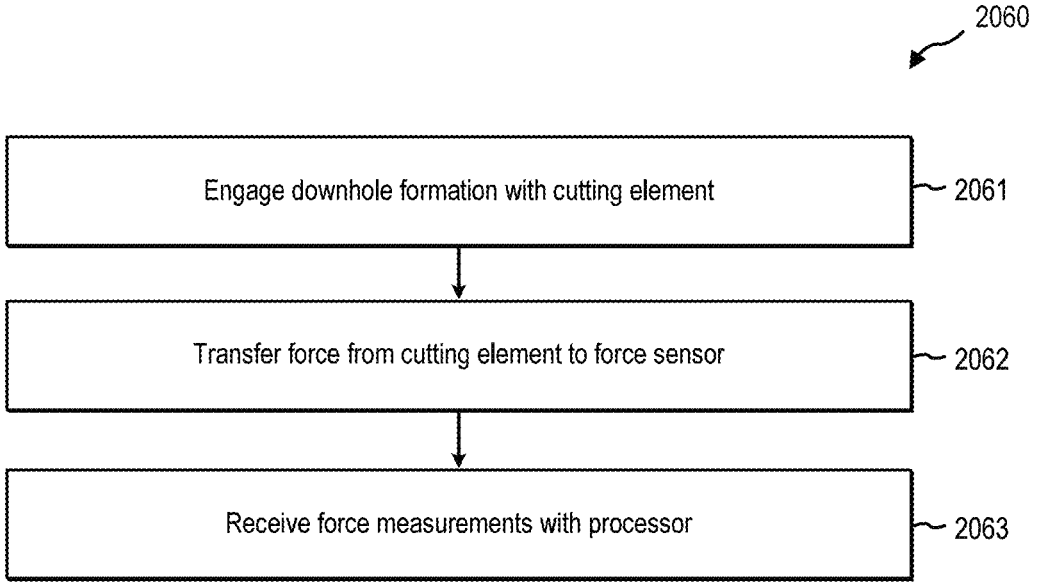
FIG. 20 illustrates a flowchart for a method or a series of acts for using an engagement element assembly, according to at least one embodiment of the present disclosure.

FIG. 20 illustrates a flowchart of a method 2060 or a series of acts for using an engagement element assembly as discussed herein, according to at least one embodiment of the present disclosure. While FIG. 20 illustrates acts according to one embodiment, alternative embodiments may one or more of omit, add to, reorder, and modify any of the acts shown in FIG. 20.

The method 2060 may include an act 2061 of engaging a downhole earth formation with an engagement element of the engagement element assembly. For example, the engagement element may engage the downhole earth formation during downhole drilling. The engagement element may engage the downhole earth formation rotationally after a lead cutting element. For example, the engagement element may follow a rotational path that has the same radius as a rotational path of the lead cutting element.

The method 2060 may include an act 2062 of transferring force from the engagement element to an engagement sensor. For example, the engagement element may experience a force (e.g., an axial force) associated with the engagement element engaging the downhole earth formation. The force may be transferred through the engagement element to a base of the engagement element. The engagement sensor may be positioned at the base of the engagement element and in this way may take one or more measurements associated with the force transferred through the engagement element. In some embodiments, the engagement element is axially fixed. For example, the engagement element may not move axially in response to the force exerted on the engagement element and/or in response to the sensor taking measurements associated with the force on the engagement element.

The method 2060 may include an act 2063 of receiving engagements measurements with a processor. For example, the sensor may be connected to or associated with electronics including a processor, which may receive and/or store the measurements of the sensor. The processor may be located in an electronics housing.

The various embodiments of the invention described herein have been described primarily with respect to one engagement element assembly, such as the bit 410 of FIG. 4 having an engagement element assembly 420. It should be understood, however, that a downhole tool (e.g., a bit) in accordance with any of the embodiments of the present disclosure may include two or more engagement element assemblies (e.g., in accordance with any of the embodiments of FIGS. 2-6 and 16-19). For example, a bit may include 2, 3, 4, 5, or more engagement element assemblies for taking multiple measurements. In some embodiments, the engagement element assemblies are each oriented and/or configured the same. In some embodiments, one or more of the engagement element assemblies are oriented and/or configured differently than another of the engagement element assemblies. For example, a first engagement element assembly may be oriented to take measurements associated with axial force and a second engagement element assembly may be oriented to take measurements associated with rotational force or torque. In some embodiments, multiple engagement element assemblies are configured to take measurements associated with axial force but are positioned at different radii and/or behind different lead cutting elements. In some embodiments, multiple engagement element assemblies are oriented to take measurements associated with rotational force at the same radius in order to ensure a more accurate measurement. One or more of the multiple engagement element assemblies may be oriented and/or configured and/or combined in any other way, in order to take one or more measurements associated with the bit and/or the formation, as described herein.

The embodiments shown herein illustrate downhole tools (e.g., bits) having instrument assemblies with various components having specific configurations and/or orientations. It should be understood, however, that the instrument assembly of the present disclosure is not limited to implementation in only a bit of a drilling system. Rather, the techniques described herein may be employed in connection with any downhole tool. For example, one or more instrument assemblies as described herein may be implemented in a reamer, a stabilizer, or any other downhole tool (e.g., downhole tools that contact and/or engage an inner wall of the borehole).

Additionally, it should be understood that the sensor engagement element described herein in various embodiments is not limited to a sensor engagement element that cuts, or configurations where the borehole is being cut, lengthened, widened, etc. To this end, the sensor engagement element may be any type of engagement element for engaging or interfacing with the borehole. For example, one or more downhole tools may implement an engagement element with an ultrahard (e.g., diamond) tip or coating that is not necessarily intended to or limited to cutting the formation. For example, a stabilizer may include one or more engagement elements (such as a stabilizer pad) for engaging the borehole for the purpose of stabilizing or centering one or more components of the drilling tool assembly, as opposed to cutting. Such engagement elements may be implemented as the sensor engagement element described herein in order to perform the techniques described herein. Other downhole tools may implement other engagement elements for the purpose of engaging the borehole that may not necessarily be limited to cutting. In other words, the sensor engagement element described herein may be any engagement element implemented in connection with any downhole tool.

Further, it should be understood that the instrument assembly of the present disclosure is not limited to only the configurations and/or orientations illustrated and described herein. For example, an instrument assembly of a downhole tool may include a sensor engagement element oriented at an angle from vertical, in a radial or outward direction, or any other orientation for engaging the borehole as described herein. In this way, any type of downhole tool may include an instrument assembly (including an engagement element) having any configuration for taking downhole measurements, and the instrument assembly may be configured, oriented, and adapted to function in accordance with the manner in which a given downhole tool engages the borehole.

INDUSTRIAL APPLICABILITY

As discussed herein in detail, the present disclosure includes a number of practical applications having features described herein that provide benefits and/or solve problems associated with taking downhole measurements with instrumented engagement elements as well as measuring and/or logging parameters generally in a downhole drilling environment. Some example benefits are discussed herein in connection with various features and functionalities provided by the techniques of instrumentation discussed herein in connection with one or more downhole tools. It will be appreciated that benefits explicitly discussed in connection with one or more embodiments described herein are provided by way of example and are not intended to be an exhaustive list of all possible benefits of the systems, methods, and devices described herein.

For example, by implementing an instrumented engagement element that takes measurements associated with force (or changes in force) corresponding to an engagement of the engagement element with the borehole, various properties and/or features of the borehole may be detected. In some situations, the formation through which a BHA is operating may have features such as cracks in the formation, veins of different types of rock, sloping or changing orientation of a layer of the formation, among others. Detecting one or more of these features may be facilitated by taking measurements associated with the forces (or more specifically the change in force) exerted on the instrumented engagement element as it engages one or more of these features. In this way, various features of the borehole may be detected to facilitate generating an image of the borehole or mapping features of the borehole and/or detecting downhole dynamics. Imaging such features can be beneficial for developing and/or implementing a strategy with respect to the drilling operations, such as knowing with an increased confidence a direction to drill to encounter sources of oil, gas, or other valuable resources. Imaging geological features can also be beneficial for determining structural properties of the borehole. Detecting downhole dynamics can be useful for understanding the behavior of one or more downhole tools. This may facilitate preventing damage to one or more components of the drilling system as well as ensuring an efficient and/or effective operation of the drilling system.

Some conventional methods of borehole imaging involve lowering imaging tools into the borehole. Consequently, drilling operations are typically stopped and the drilling tool assembly tripped or removed from the borehole. This results in costly downtime of the drilling operations, as well as the added downtime of tripping the drilling tool assembly out of and back into the borehole to accommodate implementing the imaging tools. The instrumented engagement element described herein may be implemented in a downhole tool during operation of the downhole tool. In this way, downtime of the drilling operations may be avoided, and imaging may be accomplished, for example while the borehole is being lengthened, saving time, resources, etc.

Some conventional borehole surveying and/or characterization methods require specialized tools implemented in the borehole as part of the drilling tool assembly and/or as part of the BHA, such as MWD and/or LWD tools. MWD and LWD tools are often implemented above or uphole from one or more downhole (e.g., drilling) tools such as a bit or reamer. MWD and LWD tools may take measurements and/or facilitate generating images associated with the borehole. However, because these tools are located uphole of the drilling tools (e.g., up to 100 ft), any information gathered by these measurement tools is effectively delayed with respect to the drilling tools located further downhole. In other words, MWD and LWD tools do not realistically characterize downhole dynamics as the drilling tools interact with the formation and/or characterize the earth formation proximate a point of engagement of the drilling tools. Due to this, conventional tools can have practical limits on their usefulness for making real-time decisions regarding the operation of the drilling tools located further downhole. In contrast, the techniques described herein may be implemented to take measurements at a point of engagement of one or more drilling tools with the earth formation. In this way, real-time information relevant to an immediate proximity of the drilling tools may be used to inform decisions about the operation of the drilling tools.

The following non-limiting examples are illustrative of the various permutations contemplated herein.

In some embodiments, an instrument assembly, includes an electronics housing disposed in a body of a downhole tool; an engagement element assembly connected to the electronics housing; an engagement sensor positioned at a base of the engagement element assembly; and an electronics housing seal configured to seal a pressure of at least a portion of the electronics housing. In some embodiments, the electronics housing is oriented in a longitudinal direction of the downhole tool. In some embodiments, the engagement element assembly includes an engagement element. In some embodiments, the engagement sensor includes a strain gauge. In some embodiments, the engagement element assembly is removably connected to the electronics housing. In some embodiments, the seal includes an O-ring or a gasket. In some embodiments, an engagement element of the engagement element assembly is positioned rotationally behind a lead cutting element of the downhole tool. In some embodiments, an engagement element of the engagement element assembly extends a sensor an axial distance that is greater than a cutting axial distance of a lead cutting element. In some embodiments, the engagement sensor is at least partially positioned in a sealed portion of the electronics housing.

In some embodiments, an engagement element assembly includes an engagement element having a distal end and a base; an engagement sensor positioned at the base of the engagement element; a connector configured to retain the engagement element in an engagement element pocket in a body of a downhole tool such that a force exerted on the distal end of the engagement element is transferred to the base of the engagement element; and a seal configured to seal a pressure of the engagement element pocket. In some embodiments, the engagement element is positioned in an engagement element housing, and the engagement element housing includes the connector and the seal. In some embodiments, the engagement element is a non-planar engagement element. In some embodiments, the connector is configured to removably retain the engagement element in the engagement element pocket. In some embodiments, the connector is configured to retain the engagement element in the engagement element pocket with threads or a circlip. In some embodiments, the connector is configured to retain the engagement element such that the engagement element is configured to engage a borehole. In some embodiments, the connector is configured to retain the engagement element in the engagement element pocket such that the engagement element is axially fixed.

In some embodiments, a method of using an engagement element assembly, includes engaging a downhole earth formation with an engagement element of the engagement element assembly; transferring force from the engagement element to a force sensor wherein the force sensor is positioned at a base of the engagement element, wherein the force is associated with the engagement element engaging the downhole earth formation, and wherein the engagement element is axially fixed; and receiving engagement measurements from the engagement sensor with a processor located in an electronics housing. In some embodiments, engaging the downhole earth formation includes engaging the downhole earth formation during downhole drilling. In some embodiments, engaging the downhole earth formation includes engaging the downhole earth formation with the engagement element rotationally after a lead cutting element and through a rotational path having a same radius as the lead cutting element. In some embodiments, the method includes sealing the electronics housing from a fluid penetrating into the electronics housing with the engagement element.

In some embodiments, an electronics housing includes a conduit disposed in a body of a downhole tool; an opening at a proximal end of the conduit and positioned at an outer surface of the downhole tool, wherein the conduit is configured to removably connect to an engagement element assembly at the opening; and a sealing surface configured to engage a sealing surface of the engagement element assembly to create a seal, wherein the seal is configured to maintain a pressure of the conduit. In some embodiments, the conduit is oriented in a longitudinal direction of the downhole tool. In some embodiments, the conduit includes a sleeve fixed within the conduit. In some embodiments, the outer surface of the downhole tool is a downhole end of the downhole tool. In some embodiments, the conduit is configured to removably connect to the engagement element assembly with threads located adjacent the opening. In some embodiments, the conduit is configured to removably connect to the engagement element assembly such that an engagement element of the engagement element assembly may engage a borehole.

In some embodiments, an electronics housing adapter includes a body configured to connect to a downhole tool at an inner bore of the downhole tool; a first connector configured to form a first sealed connection with an electronics housing located within the inner bore; and a second connector configured to form a second sealed connection with a wire conduit extending at least partially through a body of the downhole tool. In some embodiments, the electronics housing adapter includes one or more holes for providing a fluid flow from the inner bore to an outer surface of the downhole tool. In some embodiments, the body is configured to connect to the inner bore of the downhole tool such that the adapter is positioned between a head and a shank of the downhole tool. In some embodiments, the first sealed connection prevents fluid in the inner bore from penetrating into the electronics housing. In some embodiments, the second sealed connection prevents fluid in the inner bore from penetrating into the wire conduit. In some embodiments, the body is configured to removably connect to the downhole tool. In some embodiments, the first sealed connection is a removable connection. In some embodiments, the second sealed connection is a removable connection.

In some embodiments, an electronics housing system, includes an electronics housing positionable within a downhole tool; and a wire conduit for passing one or more wires from a sensor, at least partially through a body of the downhole tool, and to the electronics housing. In some embodiments, the electronics housing is positionable within an inner bore of the downhole tool. In some embodiments, the wire conduit is configured to pass the one or more wires through the body of the downhole tool and to the inner bore. In some embodiments, the inner bore is a fluid passage of the downhole tool. In some embodiments, the downhole tool is a first downhole tool and wherein the electronics housing is included in a downhole tool that is configured to connect to the first downhole tool. In some embodiments, the wire conduit is connected to an engagement element pocket located at an outer surface of the downhole tool. In some embodiments, the engagement element pocket is configured to seal to prevent fluid from penetrating into the wire conduit. In some embodiments, the downhole tool is a downhole bit. In some embodiments, an adapter is positionable within the downhole tool for receiving one or more wires from the wire conduit. In some embodiments, the electronics housing includes an opening, and wherein the adapter is configured to connect to the electronics housing at the opening to pass the one or more wires from the wire conduit, through the adapter, and to the electronics housing. In some embodiments, the adapter is configured to connect to the electronics housing to form a first sealed connection. In some embodiments, the adapter is configured to connect to the wired conduit to form a second sealed connection.

In some embodiments, an engagement element housing, includes a housing body configured to removably connect to an engagement element pocket formed in a body of a downhole tool such that a distal end of the housing body is positioned at an outer surface of the downhole tool; a seal configured to seal the housing body and the engagement element pocket to maintain a pressure in the engagement element pocket; and a measurement pocket configured to house one or more sensors for taking one or more downhole measurements. In some embodiments, the housing body is configured to removably connect to the engagement element pocket with threads or a circlip. In some embodiments, an engagement element housing, includes a tightener for tightening a connection of the housing body to the engagement element pocket. In some embodiments, the tightener is a hex head tightener. In some embodiments, the seal is an O-ring or a gasket. In some embodiments, the seal is configured to prevent fluid in a borehole from penetrating into the engagement element pocket.

In some embodiments, an instrument assembly, includes an engagement element housing, including a housing body configured to removably connect to an engagement element pocket in a body of a downhole tool such that a distal end of the housing body is positioned at an outer surface of the downhole tool; a seal configured to seal the housing body and the engagement element pocket to maintain a pressure in the engagement element pocket; a measurement pocket; and a diaphragm; and a sensor at the measurement pocket. In some embodiments, an engagement element is disposed in the measurement pocket and extending from the distal end of the housing body. In some embodiments, the engagement element is axially fixed in the measurement pocket. In some embodiments, the engagement element is removably connected to the housing body. In some embodiments, the engagement element is configured to engage a borehole. In some embodiments, the sensor includes a strain gauge positioned on the diaphragm. In some embodiments, an engagement element is disposed in the measurement pocket, a base of the engagement element engaging the diaphragm, and wherein the strain gauge measures a strain on the diaphragm corresponding to a force exerted on the engagement element. In some embodiments, a strain on the diaphragm is associated with a pressure of a drilling fluid exerted on the diaphragm. In some embodiments, the measurement pocket further includes a mud filter. In some embodiments, the measurement pocket extends into a side wall of the housing body, and wherein the measurement pocket includes an opening positioned toward a sealed portion of the engagement element pocket. In some embodiments, the measurement pocket extends into an engagement element retained by the housing body, and wherein the measurement pocket includes an opening positioned toward a sealed portion of the engagement element pocket. In some embodiments, the measurement pocket houses a temperature sensor.

In some embodiments, an instrument assembly, includes an engagement element housing, including a housing body configured to removably connect to an engagement element pocket in a body of a downhole tool such that a distal end of the housing body is positioned at an outer surface of the downhole tool; a seal configured to seal the housing body and the engagement element pocket to maintain a pressure in the engagement element pocket; and a measurement pocket including a diaphragm; an engagement element disposed in the measurement pocket and configured to engage a borehole; and a sensor positioned on the diaphragm in a sealed portion of the engagement element pocket. In some embodiments, a temperature sensor extends from the sealed portion of the engagement element pocket at least partially through the housing body.

In some embodiments, an instrument assembly, includes an electronics housing disposed in a body of a downhole tool; an engagement element assembly connected to the electronics housing; a strain sensor positioned at a base of the engagement element assembly; and a seal between the engagement element assembly and the electronics housing configured to seal a pressure of at least a portion of the electronics housing.

In some embodiments, an engagement element assembly, includes an engagement element having a distal end and a base; a strain sensor positioned at the base of the engagement element; a connector configured to retain the engagement element in an engagement element pocket in a body of a downhole tool such that an engagement of the engagement element with a borehole is measured as a strain at the base of the engagement element by the strain sensor; and a seal configured to seal a pressure of the engagement element pocket.

The embodiments of the instrumented engagement element have been primarily described with reference to wellbore drilling operations; the instrumented engagement element described herein may be used in applications other than the drilling of a wellbore. In other embodiments, the instrumented engagement element, according to the present disclosure, may be used outside a wellbore or other downhole environment used for the exploration or production of natural resources. For instance, the instrumented engagement element of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure may thus utilize a special purpose or general-purpose computing system including computer hardware, such as, for example, one or more processors and system memory. Embodiments within the scope of the present disclosure also include physical and other computer-readable media for carrying or storing computer-executable instructions and/or data structures, including applications, tables, data, libraries, or other modules used to execute particular functions or direct selection or execution of other modules. Such computer-readable media can be any available media that can be accessed by a general purpose or special purpose computer system. Computer-readable media that store computer-executable instructions (or software instructions) are physical storage media. Computer-readable media that carry computer-executable instructions are transmission media. Thus, by way of example, and not limitation, embodiments of the present disclosure can include at least two distinctly different kinds of computer-readable media, namely physical storage media or transmission media. Combinations of physical storage media and transmission media should also be included within the scope of computer-readable media.

Both physical storage media and transmission media may be used temporarily to store or carry, software instructions in the form of computer readable program code that allows performance of embodiments of the present disclosure. Physical storage media may further be used to persistently or permanently store such software instructions. Examples of physical storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored as or in software, hardware, firmware, or combinations thereof.

A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

Further, upon reaching various computer system components, program code in the form of computer-executable instructions or data structures can be transferred automatically or manually from transmission media to physical storage media (or vice versa). For example, computer-executable instructions or data structures received over a network or data link can be buffered in memory (e.g., RAM) within a network interface module (NIC), and then eventually transferred to computer system RAM and/or to less volatile physical storage media at a computer system. Thus, it should be understood that physical storage media can be included in computer system components that also (or even primarily) utilize transmission media.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An instrument assembly, comprising:

an electronics housing disposed in a body of a downhole tool;

an engagement element assembly connected to the electronics housing, wherein an engagement element of the engagement element assembly extends a sensor axial distance that is greater than a cutting axial distance of a lead cutting element;

an engagement sensor positioned at a base of the engagement element assembly, wherein the engagement sensor is configured to take measurements corresponding with an engagement of the engagement element assembly with a borehole; and an electronics housing seal configured to seal at least a portion of the electronics housing from a downhole pressure.

2. The instrument assembly of claim 1, wherein the electronics housing is oriented in a longitudinal direction of the downhole tool.

3. The instrument assembly of claim 1, wherein the engagement sensor includes a strain gauge and/or a load cell.

4. The instrument assembly of claim 1, wherein the engagement element assembly is removably connected to the electronics housing.

5. The instrument assembly of claim 1, wherein the electronics housing seal includes an O-ring or a gasket.

6. The instrument assembly of claim 1, wherein the electronics housing seal is an integral seal and is integrally formed as part of a body of the downhole tool.

7. The instrument assembly of claim 6, wherein the integral seal is a diaphragm integrally formed in the body of the downhole tool and wherein the diaphragm is part of the engagement sensor.

8. The instrument assembly of claim 1, wherein the engagement element assembly engages the borehole with an engagement distance of less than 1 mm.

9. The instrument assembly of claim 1, wherein the engagement element of the engagement element assembly is positioned rotationally behind the lead cutting element of the downhole tool.

10. The instrument assembly of claim 1, wherein the engagement sensor is positioned at least partially in a sealed portion of the electronics housing.

11. An engagement element assembly, comprising:

an engagement element having a distal end and a base;

an engagement sensor positioned at the base of the engagement element;

a connector configured to retain the engagement element in an engagement element pocket in a body of a downhole tool such that a force exerted on the distal end of the engagement element is transferred to the base of the engagement element; and a seal configured to seal a pressure of the engagement element pocket, wherein the engagement element is positioned in an engagement element housing, and the engagement element housing includes the connector and the seal.

12. The engagement element assembly of claim 11, wherein the engagement element is a non-planar engagement element.

13. The engagement element assembly of claim 11, wherein the connector is configured to removably retain the engagement element in the engagement element pocket.

14. The engagement element assembly of claim 11, wherein the connector is configured to retain the engagement element in the engagement element pocket with threads or a circlip.

15. The engagement element assembly of claim 11, wherein the connector is configured to retain the engagement element such that the engagement element is configured to engage a borehole.

16. The engagement element assembly of claim 11, wherein the connector is configured to retain the engagement element in the engagement element pocket such that the engagement element is axially fixed.

17. An instrument assembly, comprising:

an electronics housing disposed in a body of a downhole tool;

an engagement element assembly connected to the electronics housing, wherein an engagement element of the engagement element assembly is positioned rotationally behind a lead cutting element of the downhole tool;

an engagement sensor positioned at a base of the engagement element assembly, wherein the engagement sensor is configured to take measurements corresponding with an engagement of the engagement element assembly with a borehole; and an electronics housing seal configured to seal at least a portion of the electronics housing from a downhole pressure.

18. The instrument assembly of claim 17, wherein the electronics housing is oriented in a longitudinal direction of the downhole tool.

19. The instrument assembly of claim 17, wherein the engagement sensor includes a strain gauge and/or a load cell.

20. The instrument assembly of claim 17, wherein the engagement element assembly is removably connected to the electronics housing.

21. The instrument assembly of claim 17, wherein the electronics housing seal includes an O-ring or a gasket.

22. The instrument assembly of claim 17, wherein the electronics housing seal is an integral seal and is integrally formed as part of a body of the downhole tool.

23. The instrument assembly of claim 22, wherein the integral seal is a diaphragm integrally formed in the body of the downhole tool and wherein the diaphragm is part of the engagement sensor.

* * * * *